US007585398B2

(12) United States Patent
Hanson et al.

(10) Patent No.: US 7,585,398 B2
(45) **Date of Patent: *Sep. 8, 2009**

(54) CHAMBERS, SYSTEMS, AND METHODS FOR ELECTROCHEMICALLY PROCESSING MICROFEATURE WORKPIECES

(75) Inventors: Kyle M. Hanson, Kalispell, MT (US); John L. Klocke, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 735 days.

This patent is subject to a terminal disclaimer.

(21) Appl. No.: 10/861,899

(22) Filed: Jun. 3, 2004

(65) Prior Publication Data

US 2005/0087439 A1 Apr. 28, 2005
US 2009/0114533 A9 May 7, 2009

Related U.S. Application Data

(63) Continuation-in-part of application No. 10/729,349, filed on Dec. 5, 2003, now Pat. No. 7,351,314, and a continuation-in-part of application No. 10/729,357, filed on Dec. 5, 2003, now Pat. No. 7,351,315, and a continuation-in-part of application No. 09/872,151, filed on May 31, 2001, now Pat. No. 7,264,698, which is a continuation-in-part of application No. 09/804,697, filed on Mar. 12, 2001, now Pat. No. 6,660,137, which is a continuation of application No. PCT/US00/10120, filed on Apr. 13, 2000, application No. 10/861,899, which is a continuation-in-part of application No. 09/875,365, filed on Jun. 5, 2001, now Pat. No. 6,916,412.

(60) Provisional application No. 60/129,055, filed on Apr. 13, 1999.

(51) Int. Cl.
*C25D 7/12* (2006.01)
*C25D 17/02* (2006.01)

(52) U.S. Cl. ..... 204/260; 204/230.7

(58) Field of Classification Search ..... 204/198–297.16
See application file for complete search history.

(56) References Cited

U.S. PATENT DOCUMENTS 2,256,274 A 9/1941 Boedecker et al.
3,309,263 A 3/1967 Grobe
3,616,284 A 10/1971 Bodmer et al.

(Continued)

FOREIGN PATENT DOCUMENTS

CA 873651 6/1971
DE 41 14 427 11/1992
DE 195 25 666 10/1996

(Continued)

OTHER PUBLICATIONS

International Search Report and Written Opinion for PCT/US04/17800: Applicant: Semitool, Inc.; May 30, 2006; 17 pgs.
U.S. Appl. No. 60/129,055, McHugh.
U.S. Appl. No. 60/143,769, McHugh.

(Continued)

*Primary Examiner*—Harry D Wilkins, III
(74) *Attorney, Agent, or Firm*—Perkins Coie, LLP; Kenneth H. Ohriner; Craig E. Bohn

(57) ABSTRACT

Chambers, systems, and methods for electrochemically processing microfeature workpieces are disclosed herein. In one embodiment, an electrochemical deposition chamber includes a processing unit having a first flow system configured to convey a flow of a first processing fluid to a microfeature workpiece. The chamber further includes an electrode unit having an electrode and a second flow system configured to convey a flow of a second processing fluid at least proximate to the electrode. The chamber further includes a nonporous barrier between the processing unit and the electrode unit to separate the first and second processing fluids. The nonporous barrier is configured to allow cations or anions to flow through the barrier between the first and second processing fluids.

9 Claims, 13 Drawing Sheets

U.S. PATENT DOCUMENTS

| | | | |
|---|---|---|---|
| 3,664,933 | A | 5/1972 | Clauss |
| 3,706,635 | A | 12/1972 | Kowalski |
| 3,706,651 | A | 12/1972 | Leland |
| 3,716,462 | A | 2/1973 | Jensen |
| 3,798,003 | A | 3/1974 | Ensley et al. |
| 3,798,033 | A | 3/1974 | Yost, Jr. |
| 3,878,066 | A | 4/1975 | Dettke et al. |
| 3,930,963 | A | 1/1976 | Polichette et al. |
| 3,968,885 | A | 7/1976 | Hassan et al. |
| 4,000,046 | A | 12/1976 | Weaver |
| 4,022,679 | A | 5/1977 | Koziol et al. |
| 4,030,015 | A | 6/1977 | Herko et al. |
| 4,046,105 | A | 9/1977 | Gomez |
| 4,072,557 | A | 2/1978 | Schiel |
| 4,082,638 | A | 4/1978 | Jumer |
| 4,113,577 | A | 9/1978 | Ross et al. |
| 4,134,802 | A | 1/1979 | Herr |
| 4,137,867 | A | 2/1979 | Aigo |
| 4,165,252 | A | 8/1979 | Gibbs |
| 4,170,959 | A | 10/1979 | Aigo |
| 4,222,834 | A | 9/1980 | Bacon et al. |
| 4,238,310 | A | 12/1980 | Eckler et al. |
| 4,246,088 | A | 1/1981 | Murphy et al. |
| 4,259,166 | A | 3/1981 | Whitehurst |
| 4,287,029 | A | 9/1981 | Shimamura |
| 4,304,641 | A | 12/1981 | Grandia et al. |
| 4,323,433 | A | 4/1982 | Loch |
| 4,341,629 | A | 7/1982 | Uhlinger |
| 4,360,410 | A | 11/1982 | Fletcher et al. |
| 4,374,007 | A | 2/1983 | Barclay et al. |
| 4,378,283 | A | 3/1983 | Seyffert et al. |
| 4,384,930 | A | 5/1983 | Eckles |
| 4,391,694 | A | 7/1983 | Runsten |
| 4,422,915 | A | 12/1983 | Wielonski et al. |
| 4,431,361 | A | 2/1984 | Bayne |
| 4,437,943 | A | 3/1984 | Beck |
| 4,440,597 | A | 4/1984 | Wells et al. |
| 4,443,117 | A | 4/1984 | Muramoto et al. |
| 4,449,885 | A | 5/1984 | Hertel |
| 4,451,197 | A | 5/1984 | Lange |
| 4,463,503 | A | 8/1984 | Applegate |
| 4,466,864 | A | 8/1984 | Bacon |
| 4,469,564 | A | 9/1984 | Okinaka et al. |
| 4,469,566 | A | 9/1984 | Wray |
| 4,475,823 | A | 10/1984 | Stone |
| 4,480,028 | A | 10/1984 | Kato et al. |
| 4,495,153 | A | 1/1985 | Midorikawa |
| 4,495,453 | A | 1/1985 | Inaba |
| 4,500,394 | A | 2/1985 | Rizzo |
| 4,529,480 | A | 7/1985 | Trokhan |
| 4,541,895 | A | 9/1985 | Albert |
| 4,566,847 | A | 1/1986 | Maeda |
| 4,576,685 | A | 3/1986 | Goffredo et al. |
| 4,576,689 | A | 3/1986 | Makkaev |
| 4,585,539 | A | 4/1986 | Edson |
| 4,604,177 | A | 8/1986 | Sivilotti |
| 4,604,178 | A | 8/1986 | Fiegener |
| 4,634,503 | A | 1/1987 | Nogavich |
| 4,639,028 | A | 1/1987 | Olson |
| 4,648,944 | A | 3/1987 | George et al. |
| 4,670,126 | A | 6/1987 | Messer et al. |
| 4,685,414 | A | 8/1987 | DiRico |
| 4,687,552 | A | 8/1987 | Early et al. |
| 4,693,017 | A | 9/1987 | Oehler et al. |
| 4,696,729 | A | 9/1987 | Santini |
| 4,715,934 | A | 12/1987 | Tamminen |
| 4,741,624 | A | 5/1988 | Barroyer |
| 4,760,671 | A | 8/1988 | Ward |
| 4,761,214 | A | 8/1988 | Hinman |
| 4,770,590 | A | 9/1988 | Hugues et al. |
| 4,781,800 | A | 11/1988 | Goldman |
| 4,800,818 | A | 1/1989 | Kawaguchi et al. |
| 4,828,654 | A | 5/1989 | Reed |
| 4,849,054 | A | 7/1989 | Klowak |
| 4,858,539 | A | 8/1989 | Schumann |
| 4,864,239 | A | 9/1989 | Casarcia et al. |
| 4,868,992 | A | 9/1989 | Crafts et al. |
| 4,898,647 | A | 2/1990 | Luce et al. |
| 4,902,398 | A | 2/1990 | Homstad |
| 4,906,341 | A | 3/1990 | Yamakawa |
| 4,913,085 | A | 4/1990 | Vohringer et al. |
| 4,924,890 | A | 5/1990 | Giles et al. |
| 4,944,650 | A | 7/1990 | Matsumoto |
| 4,949,671 | A | 8/1990 | Davis et al. |
| 4,951,601 | A | 8/1990 | Maydan et al. |
| 4,959,278 | A | 9/1990 | Shimauch |
| 4,962,726 | A | 10/1990 | Matsushita et al. |
| 4,979,464 | A | 12/1990 | Kunze-Concewitz et al. |
| 4,988,533 | A | 1/1991 | Freeman et al. |
| 5,000,827 | A | 3/1991 | Schuster |
| 5,024,746 | A | 6/1991 | Stierman et al. |
| 5,026,239 | A | 6/1991 | Chiba |
| 5,048,589 | A | 9/1991 | Cook et al. |
| 5,054,988 | A | 10/1991 | Shiraiwa |
| 5,055,036 | A | 10/1991 | Asano et al. |
| 5,061,144 | A | 10/1991 | Akimoto |
| 5,069,548 | A | 12/1991 | Boehnlein |
| 5,078,852 | A | 1/1992 | Yee |
| 5,083,364 | A | 1/1992 | Olbrich et al. |
| 5,096,550 | A | 3/1992 | Mayer |
| 5,110,248 | A | 5/1992 | Asano et al. |
| 5,115,430 | A | 5/1992 | Hahne |
| 5,125,784 | A | 6/1992 | Asano |
| 5,128,912 | A | 7/1992 | Hug et al. |
| 5,135,636 | A | 8/1992 | Yee et al. |
| 5,138,973 | A | 8/1992 | Davis et al. |
| 5,146,136 | A | 9/1992 | Ogura |
| 5,151,168 | A | 9/1992 | Gilton |
| 5,155,336 | A | 10/1992 | Gronet et al. |
| 5,156,174 | A | 10/1992 | Thompson |
| 5,156,730 | A | 10/1992 | Bhatt |
| 5,162,079 | A | 11/1992 | Brown et al. |
| 5,168,886 | A | 12/1992 | Thompson et al. |
| 5,168,887 | A | 12/1992 | Thompson |
| 5,169,408 | A | 12/1992 | Biggerstaff et al. |
| 5,172,803 | A | 12/1992 | Lewin |
| 5,174,045 | A | 12/1992 | Thompson et al. |
| 5,178,512 | A | 1/1993 | Skrobak |
| 5,178,639 | A | 1/1993 | Nishi |
| 5,180,273 | A | 1/1993 | Salaya et al. |
| 5,183,377 | A | 2/1993 | Becker et al. |
| 5,186,594 | A | 2/1993 | Toshima et al. |
| 5,209,817 | A | 5/1993 | Ahmad et al. |
| 5,217,586 | A | 6/1993 | Datta |
| 5,222,310 | A | 6/1993 | Thompson |
| 5,227,041 | A | 7/1993 | Brogden |
| 5,228,232 | A | 7/1993 | Miles |
| 5,228,966 | A | 7/1993 | Murata |
| 5,230,371 | A | 7/1993 | Lee |
| 5,232,511 | A | 8/1993 | Bergman |
| 5,235,995 | A | 8/1993 | Bergman et al. |
| 5,238,500 | A | 8/1993 | Bergman |
| 5,252,137 | A | 10/1993 | Tateyama et al. |
| 5,252,807 | A | 10/1993 | Chizinsky |
| 5,256,262 | A | 10/1993 | Blomsterberg |
| 5,256,274 | A | 10/1993 | Poris |
| 5,271,953 | A | 12/1993 | Litteral |
| 5,271,972 | A | 12/1993 | Kwok et al. |
| 5,301,700 | A | 4/1994 | Kamikawa et al. |
| 5,302,464 | A | 4/1994 | Nomura et al. |
| 5,306,895 | A | 4/1994 | Ushikoshi et al. |
| 5,314,294 | A | 5/1994 | Taniguchi et al. |
| 5,316,642 | A | 5/1994 | Young |
| 5,326,455 | A | 7/1994 | Kubo et al. |

5,330,604 A 7/1994 Allum et al.
5,332,271 A 7/1994 Grant et al.
5,332,445 A 7/1994 Bergman
5,340,456 A 8/1994 Mehler
5,344,491 A 9/1994 Katou
5,348,620 A 9/1994 Hermans et al.
5,364,504 A 11/1994 Smurkoski et al.
5,366,785 A 11/1994 Sawdai
5,366,786 A 11/1994 Connor et al.
5,368,711 A 11/1994 Poris
5,372,848 A 12/1994 Blackwell
5,376,176 A 12/1994 Kuriyama
5,377,708 A 1/1995 Bergman
5,388,945 A 2/1995 Garric et al.
5,391,285 A 2/1995 Lytle
5,391,517 A 2/1995 Gelatos et al.
5,405,518 A 4/1995 Hsieh et al.
5,411,076 A 5/1995 Matsunaga et al.
5,421,987 A 6/1995 Tzanavaras et al.
5,427,674 A 6/1995 Langenskiold et al.
5,429,686 A 7/1995 Chiu et al.
5,429,733 A 7/1995 Ishida
5,431,803 A 7/1995 DiFranco et al.
5,437,777 A 8/1995 Kishi
5,441,629 A 8/1995 Kosaki
5,442,416 A 8/1995 Tateyama et al.
5,443,707 A 8/1995 Mori
5,445,484 A 8/1995 Kato et al.
5,447,615 A 9/1995 Ishida
5,454,405 A 10/1995 Hawes
5,460,478 A 10/1995 Akimoto et al.
5,464,313 A 11/1995 Ohsawa
5,472,502 A 12/1995 Batchelder
5,489,341 A 2/1996 Bergman et al.
5,500,081 A 3/1996 Bergman
5,501,768 A 3/1996 Hermans et al.
5,508,095 A 4/1996 Allum et al.
5,512,319 A 4/1996 Cook et al.
5,514,258 A 5/1996 Brinket et al.
5,516,412 A 5/1996 Andricacos et al.
5,522,975 A 6/1996 Andricacos et al.
5,527,390 A 6/1996 Ono et al.
5,544,421 A 8/1996 Thompson et al.
5,549,808 A 8/1996 Farooq
5,567,267 A 10/1996 Kazama et al.
5,571,325 A 11/1996 Ueyama
5,575,611 A 11/1996 Thompson et al.
5,584,310 A 12/1996 Bergman
5,584,971 A 12/1996 Komino
5,593,545 A 1/1997 Rugowski et al.
5,597,460 A 1/1997 Reynolds
5,597,836 A 1/1997 Hackler et al.
5,600,532 A 2/1997 Michiya et al.
5,609,239 A 3/1997 Schlecker
5,620,581 A 4/1997 Ang
5,639,206 A 6/1997 Oda et al.
5,639,316 A 6/1997 Cabral
5,641,613 A 6/1997 Boff et al.
5,650,082 A 7/1997 Anderson
5,651,823 A 7/1997 Parodi et al.
5,658,387 A 8/1997 Reardon
5,660,472 A 8/1997 Peuse et al.
5,660,517 A 8/1997 Thompson et al.
5,662,788 A 9/1997 Sandhu
5,664,337 A 9/1997 Davis et al.
5,670,034 A 9/1997 Lowery
5,676,337 A 10/1997 Giras et al.
5,677,118 A 10/1997 Spara et al.
5,678,320 A 10/1997 Thompson et al.
5,681,392 A 10/1997 Swain
5,683,564 A 11/1997 Reynolds
5,684,654 A 11/1997 Searle et al.
5,684,713 A 11/1997 Asada et al.
5,700,127 A 12/1997 Harada
5,711,646 A 1/1998 Ueda et al.
5,723,028 A 3/1998 Poris
5,731,678 A 3/1998 Zila et al.
5,744,019 A 4/1998 Ang
5,746,565 A 5/1998 Tepolt
5,747,098 A 5/1998 Larson
5,754,842 A 5/1998 Minagawa
5,755,948 A 5/1998 Lazaro et al.
5,759,006 A 6/1998 Miyamoto et al.
5,762,751 A 6/1998 Bleck
5,765,444 A 6/1998 Bacchi
5,765,889 A 6/1998 Nam et al.
5,776,327 A 7/1998 Botts et al.
5,785,826 A 7/1998 Greenspan
5,788,829 A 8/1998 Joshi et al.
5,802,856 A 9/1998 Schaper et al.
5,829,791 A 11/1998 Kotsubo et al.
5,843,296 A 12/1998 Greenspan
5,871,626 A 2/1999 Crafts
5,871,805 A 2/1999 Lemelson
5,882,498 A 3/1999 Dubin
5,883,762 A 3/1999 Calhoun et al.
5,892,207 A 4/1999 Kawamura et al.
5,904,827 A 5/1999 Reynolds
5,908,540 A * 6/1999 Fanti ..... 204/242
5,908,543 A 6/1999 Matsunami
5,925,227 A 7/1999 Kobayashi et al.
5,932,077 A 8/1999 Reynolds
5,937,142 A 8/1999 Moslehi et al.
5,957,836 A 9/1999 Johnson
5,980,706 A 11/1999 Bleck
5,985,126 A 11/1999 Bleck
5,989,397 A 11/1999 Laube et al.
5,989,406 A 11/1999 Beetz
5,998,123 A 12/1999 Tanaka et al.
5,999,886 A 12/1999 Martin et al.
6,001,235 A 12/1999 Arken et al.
6,004,828 A 12/1999 Hanson
6,017,820 A 1/2000 Ting et al.
6,027,631 A 2/2000 Broadbent
6,028,986 A 2/2000 Song
6,051,284 A 4/2000 Byrne
6,053,687 A 4/2000 Kirkpatrick
6,072,160 A 6/2000 Bahl
6,072,163 A 6/2000 Armstrong et al.
6,074,544 A 6/2000 Reid
6,080,288 A 6/2000 Schwartz et al.
6,080,291 A 6/2000 Woodruff et al.
6,080,691 A 6/2000 Lindsay et al.
6,086,680 A 7/2000 Foster et al.
6,090,260 A 7/2000 Inoue
6,091,498 A 7/2000 Hanson
6,099,702 A 8/2000 Reid
6,099,712 A 8/2000 Ritzdorf
6,103,085 A 8/2000 Woo et al.
6,107,192 A 8/2000 Subrahmanyan et al.
6,108,937 A 8/2000 Raaijmakers
6,110,011 A 8/2000 Somekh
6,110,346 A 8/2000 Reid
6,126,798 A 10/2000 Reid et al.
6,130,415 A 10/2000 Knoot
6,136,163 A 10/2000 Cheung
6,139,703 A 10/2000 Hanson et al.
6,139,712 A 10/2000 Patton
6,140,234 A 10/2000 Uzoh et al.
6,143,147 A 11/2000 Jelinek
6,143,155 A 11/2000 Adams
6,151,532 A 11/2000 Barone et al.
6,156,167 A 12/2000 Patton
6,157,106 A 12/2000 Tietz et al.
6,159,354 A 12/2000 Contolini
6,162,344 A 12/2000 Reid

| | | | | |
|---|---|---|---|---|
| 6,162,488 | A | 12/2000 | Gevelber et al. | |
| 6,168,695 | B1 | 1/2001 | Woodruff | |
| 6,174,425 | B1 | 1/2001 | Simpson | |
| 6,174,796 | B1 | 1/2001 | Takagi et al. | |
| 6,179,983 | B1 | 1/2001 | Reid | |
| 6,221,230 | B1 | 1/2001 | Takeuchi | |
| 6,184,068 | B1 | 2/2001 | Ohtani et al. | |
| 6,193,859 | B1 | 2/2001 | Contolini | |
| 6,199,301 | B1 | 3/2001 | Wallace | |
| 6,218,097 | B1 | 4/2001 | Bell et al. | |
| 6,228,232 | B1 | 5/2001 | Woodruff | |
| 6,234,738 | B1 | 5/2001 | Kimata | |
| 6,251,238 | B1 | 6/2001 | Kaufman et al. | |
| 6,251,528 | B1 | 6/2001 | Uzoh et al. | |
| 6,254,742 | B1 | 7/2001 | Hanson et al. | |
| 6,258,220 | B1 | 7/2001 | Dordi | |
| 6,261,433 | B1 | 7/2001 | Landau | |
| 6,270,647 | B1 | 8/2001 | Graham | |
| 6,277,263 | B1 | 8/2001 | Chen | |
| 6,278,089 | B1 | 8/2001 | Young et al. | |
| 6,280,183 | B1 | 8/2001 | Mayur et al. | |
| 6,280,582 | B1 | 8/2001 | Woodruff et al. | |
| 6,280,583 | B1 | 8/2001 | Woodruff et al. | |
| 6,623,609 | B2 | 9/2001 | Harris | |
| 6,297,154 | B1 | 10/2001 | Gross et al. | |
| 6,303,010 | B1 | 10/2001 | Woodruff et al. | |
| 6,309,520 | B1 | 10/2001 | Woodruff et al. | |
| 6,309,524 | B1 | 10/2001 | Woodruff et al. | |
| 6,318,951 | B1 | 11/2001 | Schmidt | |
| 6,322,112 | B1 | 11/2001 | Duncan | |
| 6,322,677 | B1 | 11/2001 | Woodruff | |
| 6,342,137 | B1 | 1/2002 | Woodruff | |
| 6,365,729 | B1 | 4/2002 | Tyagi et al. | |
| 6,391,166 | B1 | 5/2002 | Wang | |
| 6,402,923 | B1 | 6/2002 | Mayer | |
| 6,409,892 | B1 | 6/2002 | Woodruff et al. | |
| 6,428,660 | B2 | 8/2002 | Woodruff et al. | |
| 6,428,662 | B1 | 8/2002 | Woodruff et al. | |
| 6,436,267 | B1 | 8/2002 | Carl et al. | |
| 6,444,101 | B1 | 9/2002 | Stevens et al. | |
| 6,471,913 | B1 | 10/2002 | Weaver et al. | |
| 6,481,956 | B1 | 11/2002 | Hofmeister | |
| 6,491,806 | B1 | 12/2002 | Dubin | |
| 6,497,801 | B1 | 12/2002 | Woodruff | |
| 6,527,920 | B1 | 3/2003 | Mayer et al. | |
| 6,562,421 | B2 | 5/2003 | Sudo et al. | |
| 6,565,729 | B2 | 5/2003 | Chen et al. | |
| 6,569,297 | B2 | 5/2003 | Wilson et al. | |
| 6,599,412 | B1 | 7/2003 | Graham | |
| 6,632,334 | B2 | 10/2003 | Anderson et al. | |
| 6,654,122 | B1 | 11/2003 | Hanson | |
| 6,660,137 | B2 | 12/2003 | Wilson et al. | |
| 6,672,820 | B1 | 1/2004 | Hanson | |
| 6,678,055 | B2 | 1/2004 | Du-Nour et al. | |
| 6,699,373 | B2 | 3/2004 | Woodruff et al. | |
| 6,709,562 | B1 | 3/2004 | Andricacos et al. | |
| 6,749,390 | B2 | 6/2004 | Woodruff et al. | |
| 6,752,584 | B2 | 6/2004 | Woodruff et al. | |
| 6,755,954 | B2 | 6/2004 | Mayer et al. | |
| 6,773,571 | B1 | 8/2004 | Mayer | |
| 6,780,374 | B2 | 8/2004 | Weaver et al. | |
| 6,916,412 | B2 | 7/2005 | Woodruff et al. | |
| 6,921,468 | B2 | 7/2005 | Graham et al. | |
| 2001/0024611 | A1 | 9/2001 | Woodruff | |
| 2001/0032788 | A1* | 10/2001 | Woodruff et al. | 205/687 |
| 2001/0043856 | A1 | 11/2001 | Woodruff | |
| 2002/0008036 | A1 | 1/2002 | Wang | |
| 2002/0008037 | A1 | 1/2002 | Wilson | |
| 2002/0032499 | A1 | 3/2002 | Wilson | |
| 2002/0046952 | A1 | 4/2002 | Graham | |
| 2002/0053509 | A1 | 5/2002 | Hanson et al. | |
| 2002/0079215 | A1 | 6/2002 | Wilson et al. | |
| 2002/0096508 | A1 | 7/2002 | Weaver et al. | |
| 2002/0125141 | A1 | 9/2002 | Wilson | |
| 2002/0139678 | A1 | 10/2002 | Wilson | |
| 2002/0195351 | A1* | 12/2002 | Lu et al. | 205/574 |
| 2003/0038035 | A1 | 2/2003 | Wilson | |
| 2003/0062258 | A1 | 4/2003 | Woodruff | |
| 2003/0070918 | A1 | 4/2003 | Hanson | |
| 2003/0127337 | A1 | 7/2003 | Hanson | |
| 2004/0031693 | A1 | 2/2004 | Chen | |
| 2004/0055877 | A1 | 3/2004 | Wilson | |
| 2004/0099533 | A1 | 5/2004 | Wilson | |
| 2004/0188259 | A1 | 9/2004 | Wilson | |
| 2005/0087439 | A1* | 4/2005 | Hanson et al. | 204/263 |

FOREIGN PATENT DOCUMENTS

| | | | |
|---|---|---|---|
| EP | 0 140 404 | A1 | 8/1984 |
| EP | 0047132 | B1 | 7/1985 |
| EP | 0 677 612 | A3 | 10/1985 |
| EP | 0 257 670 | | 3/1988 |
| EP | 0 290 210 | | 11/1988 |
| EP | 0290210 | | 11/1988 |
| EP | 0 677 612 | A2 | 10/1995 |
| EP | 0582019 | B1 | 10/1995 |
| EP | 0544311 | B1 | 5/1996 |
| EP | 0 881 673 | A2 | 5/1998 |
| EP | 0 982 771 | A1 | 8/1999 |
| EP | 1 069 213 | A2 | 7/2000 |
| EP | 0452939 | B1 | 11/2000 |
| GB | 2217107 | A | 3/1989 |
| GB | 2 254 288 | A | 3/1992 |
| GB | 2 279 372 | A | 6/1994 |
| JP | 59-15094 | A | 8/1984 |
| JP | 1048442 | | 2/1989 |
| JP | 220800 | | 8/1990 |
| JP | 4144150 | | 5/1992 |
| JP | 4311591 | | 11/1992 |
| JP | 5146984 | | 6/1993 |
| JP | 5195183 | A | 8/1993 |
| JP | 5211224 | | 8/1993 |
| JP | 6017291 | A | 1/1994 |
| JP | 6073598 | A | 3/1994 |
| JP | 6224202 | A | 8/1994 |
| JP | 7113159 | A | 5/1995 |
| JP | 7197299 | | 8/1995 |
| JP | 7197299 | A | 8/1995 |
| JP | 10-083960 | | 3/1998 |
| JP | 11036096 | A | 2/1999 |
| JP | 11080993 | A | 3/1999 |
| JP | 11-350185 | | 12/1999 |
| JP | 2000-087299 | | 3/2000 |
| JP | 2000-256896 | | 9/2000 |
| JP | 2001-64795 | | 3/2001 |
| JP | 2004-097856 | | 4/2004 |
| WO | WO-90/00476 | | 1/1990 |
| WO | WO-91/04213 | | 4/1991 |
| WO | WO-95/06326 | | 3/1995 |
| WO | WO-95/20064 | | 7/1995 |
| WO | WO-99/16936 | | 4/1996 |
| WO | WO 99/25902 | A1 * | 5/1999 |
| WO | WO-99/25904 | | 5/1999 |
| WO | WO-99/25905 | | 5/1999 |
| WO | WO-99/40615 | | 8/1999 |
| WO | WO-99/41434 | | 8/1999 |
| WO | WO-99/45745 | | 9/1999 |
| WO | WO-00/02675 | | 1/2000 |
| WO | WO-00/02808 | | 1/2000 |
| WO | WO-00/03072 | | 1/2000 |
| WO | WO-02/02808 | | 1/2000 |
| WO | WO-00/32835 | | 6/2000 |
| WO | WO-00/61498 | | 10/2000 |
| WO | WO-00/61837 | | 10/2000 |
| WO | WO-01/46910 | | 6/2001 |
| WO | WO-01/90434 | | 11/2001 |

| | | |
|---|---|---|
| WO | WO-01/91163 | 11/2001 |
| WO | WO-02/17203 | 2/2002 |
| WO | WO-02/45476 | 6/2002 |
| WO | WO-02/097165 | 12/2002 |
| WO | WO-02/099165 | 12/2002 |
| WO | WO-03/018874 | 3/2003 |
| WO | WO-03/072853 | 9/2003 |

OTHER PUBLICATIONS

U.S. Appl. No. 60/182,160, McHugh et al.
U.S. Appl. No. 60/206,663, Wilson et al.
U.S. Appl. No. 60/294,690, Gibbons et al.
U.S. Appl. No. 60/316,597, Hanson.
U.S. Appl. No. 60/607,046, Klocke.
U.S. Appl. No. 60/607,460, Klocke.
Patent Abstract of Japan, "Plating Method" Publication No. 57171690, Publication Date: Oct. 22, 1982.
Patent Abstract of Japan, English Abstract Translation—Japanese Utility Model No. 2538705, Publication Date: Aug. 25, 1992.
Ritter et al., "Two- and Three-Dimensional Numberical Modeling of Copper Electroplating For Advanced ULSI Metallization," E-MRS Conference, Symposium M, Basic Models to Enhance Reliability; Strasbourg (France), 1999.
Ritter et al., "Two- Three-Dimensional Numberical Modeling of Copper Electroplating For Advanced ULSI Metallization," E-MRS Conference Symposium M. Basic Models to Enhance Reliability, Strabourg (France) 1999.
Ritter, G., et al., "Two-And Three-Dimensional Numerical Modeling of Copper Electroplating For Advanced ULSI Metallization," Jun. 1999, 13 pgs, E-MRS Conference Symposium M. Basic Models to Enhance Reliability, Strasbourg, France.
Singer, P., "Copper Goes Mainstream: Low k to Follow," Semiconductor International, pp. 67-70, Nov. 1997.
Office Action issued by the Japanese Patent Office on May 26, 2008 in Japanese Patent Application No. 2003-500322.
Contolini et al., "Copper Electroplating Process for Sub-Half-Micron ULSI Structures," VMIC Conference 1995 ISMIC—04/95/0322, pp. 322-328, Jun. 17-29, 1995.
Devaraj et al., "Pulsed Electrodeposition of Copper," Plating & Surface Finishing, pp. 72-78, Aug. 1992.
Dubin, "Copper Plating Techiques for ULSI Metallization," Advanced MicroDevices.
Dubin, V.M., "Electrochemical Deposition of Copper for On-Chip Interconnects," Advanced MicroDevices.
Gauvin et al., "The Effect of Chloride Ions on Copper Deposition," J. of Electrochemical Society, vol. 99, pp. 71-75, Feb. 1952.
International Search Report for PCT/US02/17840; Applicant: Semitool, Inc., Mar. 3, 2003, 4 pgs.
International Search Report for PCT/US02/28071; Applicant: Semitool, Inc., Dec. 13, 2002, 4 pgs.
International Search Report PCT/US02/17203; Semitool, Inc., Dec. 31, 2002, 4 pgs.
Lee, Tien-Yu Tom et al., "Application of a CFD Tool in Designing a Fountain Plating Cell for Uniform Bump Plating of Semiconductor Wafers," IEEE Transactions On Components, Packaging and Manufacturing Technology—Part B, Feb. 1996, pp. 131-137, vol. 19, No. 1, IEEE.
Lee, Tien-Yu Tom et al., "Application of a CFD Tool in Designing a Fountain Plating Cell for Uniform Bump Plating of Semiconductor Wafers," IEEE Transactions on Components, Packaging and Manufacturing Technology, Feb. 1996, pp. 131-137, vol. 19, No. 1.
Lee, Tien-Yu Tom, "Application of a CFD Tool in Designing a Fountain Plating Cell for Uniform Bump Plating of Semiconductor Wafers," IEE Transactions on Components, Packaging, and Manufacturing Technology (Feb. 1996), vol. 19, No. 1, IEEE.
Lowenheim, F.A., "Electroplating," Jan. 1979, 12 pgs, McGraw-Hill Book Company.
Lowenheim, Frederick A., "Electroplating," Jan. 1979, 12 pgs, McGraw-Hill Book Company, USA.
Lowenheim, Frederick A., "Electroplating Electrochemistry Applied to Electroplating," 1978, pp. 152-155, McGraw-Hill Book Company, New York.
Ossro, N.M., "An Overview of Pulse Plating," Plating and Surface Finishing, Mar. 1986.
Passal, F., "Copper Plating During the Last Fifty Years," Plating, pp. 628-638, Jun. 1959.
Patent Abstract of Japan, "Organic Compound and its Application" Publication No. 08-003153, Publication Date: Jan. 9, 1996.
Patent Abstract of Japan, "Partial Plating Device," Publication No. 01234590, Publication Date: Sep. 19, 1989.

* cited by examiner

CHAMBERS, SYSTEMS, AND METHODS FOR ELECTROCHEMICALLY PROCESSING MICROFEATURE WORKPIECES

CROSS-REFERENCE TO RELATED APPLICATION

This application is a continuation in part of U.S. Application numbers:

(a) Ser. No. 10/729,349, filed on Dec. 5, 2003, now U.S. Pat. No. 7,351,314;

(b) Ser. No. 10/729,357 filed on Dec. 5, 2003, now U.S. Pat. No. 7,351,315; and (c) Ser. No. 09/872,151, filed on May 31, 2001, now U.S. Pat. No. 7,264,698, which is a continuation-in-part of U.S. application Ser. No. 09/804,697, filed on Mar. 12, 2001, now U.S. Pat. No. 6,660,137, which is a continuation of International Patent Application No. PCT/US00/10120 filed on Apr. 13, 2000 and published in the English language, which claims the benefit of U.S. Application No. 60/129,055, filed on Apr. 13, 1999. All of the foregoing are incorporated herein by reference. This application is also a continuation in part of U.S. application Ser. No. 09/875,365, filed on Jun. 5, 2001, now U.S. Pat. No. 6,916,412.

TECHNICAL FIELD

This application relates to chambers, systems, and methods for electrochemically processing microfeature workpieces having a plurality of microdevices integrated in and/or on the workpiece. The microdevices can include submicron features. Particular aspects of the present invention are directed toward electrochemical deposition chambers having nonporous barriers to separate a first processing fluid and a second processing fluid. Additional aspects of this application are directed toward electrochemical deposition chambers having (a) a barrier between a first processing fluid and a second processing fluid, and (b) a plurality of independently operable electrodes in the second processing fluid.

BACKGROUND

Microelectronic devices, such as semiconductor devices, imagers, and displays, are generally fabricated on and/or in microelectronic workpieces using several different types of machines ("tools"). Many such processing machines have a single processing station that performs one or more procedures on the workpieces. Other processing machines have a plurality of processing stations that perform a series of different procedures on individual workpieces or batches of workpieces. In a typical fabrication process, one or more layers of conductive materials are formed on the workpieces during deposition stages. The workpieces are then typically subject to etching and/or polishing procedures (i.e., planarization) to remove a portion of the deposited conductive layers for forming electrically isolated contacts and/or conductive lines.

Tools that plate metals or other materials on the workpieces are becoming an increasingly useful type of processing machine. Electroplating and electroless plating techniques can be used to deposit copper, solder, permalloy, gold, silver, platinum, electrophoretic resist and other materials onto workpieces for forming blanket layers or patterned layers. A typical copper plating process involves depositing a copper seed layer onto the surface of the workpiece using chemical vapor deposition (CVD), physical vapor deposition (PVD), electroless plating processes, or other suitable methods. After forming the seed layer, a blanket layer or patterned layer of copper is plated onto the workpiece by applying an appropriate electrical potential between the seed layer and an anode in the presence of an electroprocessing solution. The workpiece is then cleaned, etched and/or annealed in subsequent procedures before transferring the workpiece to another processing machine.

FIG. 1 illustrates an embodiment of a single-wafer processing station 1 that includes a container 2 for receiving a flow of electroplating solution from a fluid inlet 3 at a lower portion of the container 2. The processing station 1 can include an anode 4, a plate-type diffuser 6 having a plurality of apertures 7, and a workpiece holder 9 for carrying a workpiece 5. The workpiece holder 9 can include a plurality of electrical contacts for providing electrical current to a seed layer on the surface of the workpiece 5. When the seed layer is biased with a negative potential relative to the anode 4, it acts as a cathode. In operation, the electroplating fluid flows around the anode 4, through the apertures 7 in the diffuser 6, and against the plating surface of the workpiece 5. The electroplating solution is an electrolyte that conducts electrical current between the anode 4 and the cathodic seed layer on the surface of the workpiece 5. Therefore, ions in the electroplating solution plate the surface of the workpiece 5.

The plating machines used in fabricating microelectronic devices must meet many specific performance criteria. For example, many plating processes must be able to form small contacts in vias or trenches that are less than 0.5 μm wide, and often less than 0.1 μm wide. A combination of organic additives such as "accelerators," "suppressors," and "levelers" can be added to the electroplating solution to improve the plating process within the trenches so that the plating metal fills the trenches from the bottom up. As such, maintaining the proper concentration of organic additives in the electroplating solution is important to properly fill very small features.

One drawback of conventional plating processes is that the organic additives decompose and break down proximate to the surface of the anode. Also, as the organic additives decompose, it is difficult to control the concentration of organic additives and their associated breakdown products in the plating solution, which can result in poor feature filling and nonuniform layers. Moreover, the decomposition of organic additives produces by-products that can cause defects or other nonuniformities. To reduce the rate at which organic additives decompose near the anode, other anodes such as copper-phosphorous anodes can be used.

Another drawback of conventional plating processes is that organic additives and/or chloride ions in the electroplating solution can alter pure copper anodes. This can alter the electrical field, which can result in inconsistent processes and nonuniform layers. Thus, there is a need to improve the plating process to reduce the adverse effects of the organic additives.

Still another drawback of electroplating is providing a desired electrical field at the surface of the workpiece. The distribution of electrical current in the plating solution is a function of the uniformity of the seed layer across the contact surface, the configuration/condition of the anode, the configuration of the chamber, and other factors. However, the current density profile on the plating surface can change during a plating cycle. For example, the current density profile typically changes during a plating cycle as material plates onto the seed layer. The current density profile can also change over a longer period of time because (a) the shape of consumable anodes changes as they erode, and (b) the concentration of constituents in the plating solution can change.

Therefore, it can be difficult to maintain a desired current density at the surface of the workpiece.

SUMMARY

The present invention is directed, in part, toward electrochemical deposition chambers with nonporous barriers to separate processing fluids. The chambers are divided into two distinct systems that interact with each other to electroplate a material onto the workpiece while controlling migration of selected elements in the processing fluids (e.g., organic additives) from crossing the barrier to avoid the problems caused when organic additives are proximate to the anode and when bubbles or other matter get into the processing fluid.

The chambers include a processing unit to provide a first processing fluid to a workpiece (i.e., working electrode), an electrode unit for conveying a flow of a second processing fluid different than the first processing fluid, and an electrode (i.e., counter electrode) in the electrode unit. The chambers also include a nonporous barrier between the first processing fluid and the second processing fluid. The nonporous barrier allows ions to pass through the barrier but inhibits nonionic species from passing between the first and second processing fluids. As such, the nonporous barrier separates and isolates components of the first and second processing fluids from each other such that the first processing fluid can have different chemical characteristics than the second processing fluid. For example, the first processing fluid can be a catholyte having organic additives and the second processing fluid can be an anolyte without organic additives or a much lower concentration of such additives.

The nonporous barrier provides several advantages by substantially preventing the organic additives in the catholyte from migrating to the anolyte. First, because the organic additives are prevented from being in the anolyte, they cannot flow past the anode and decompose into products that interfere with the plating process. Second, because the organic additives do not decompose at the anode, they are consumed at a much slower rate in the catholyte so that it is less expensive and easier to control the concentration of organic additives in the catholyte. Third, less expensive anodes, such as pure copper anodes, can be used in the anolyte because the risk of passivation is reduced or eliminated.

The present invention is also directed toward electrochemical deposition chambers with (a) a porous and/or nonporous barrier between processing fluids to mitigate or eliminate the problems caused by organic additives, and (b) multiple independently operable electrodes to provide and maintain a desired current density at the surface of the workpiece. These chambers are also divided into two distinct systems that interact with each other to electroplate a material onto the workpiece while controlling migration of selected elements in the processing fluids (e.g., organic additives) from crossing the barrier to avoid the problems caused by the interaction between the organic additives and the anode and by bubbles or particulates in the processing fluid. Additionally, the independently operable electrodes provide better control of the electrical field at the surface of the workpiece compared to systems that have only a single electrode.

The chambers include a processing unit to provide a first processing fluid to a workpiece (i.e., working electrode), an electrode unit for conveying a flow of a second processing fluid different than the first processing fluid, and a plurality of electrodes (i.e., counter electrodes) in the electrode unit. The chambers also include a barrier between the first processing fluid and the second processing fluid. The barrier can be a porous, permeable member that permits fluid and small molecules to flow through the barrier between the first and second processing fluids. Alternatively, the barrier can be a nonporous, semipermeable member that prevents fluid flow between the first and second processing fluids while allowing ions to pass between the fluids. The barrier may also comprise a member having porous areas and nonporous areas. The barrier of these embodiments separates and/or isolates components of the first and second processing fluids from each other such that the first processing fluid can have different chemical characteristics than the second processing fluid. For example, the first processing fluid can be a catholyte having organic additives and the second processing fluid can be an anolyte without organic additives or with a much lower concentration of such additives.

The multiple electrodes in this aspect of the invention can be controlled independently of one another to tailor the electrical field to the workpiece. Each electrode can have a current level such that the electrical field generated by all of the electrodes provides the desired plating profile at the surface of the workpiece. Additionally, the current applied to each electrode can be independently varied throughout a plating cycle to compensate for differences that occur at the surface of the workpiece as the thickness of the plated layer increases.

The combination of having multiple electrodes to control the electrical field and a barrier in the chamber will provide a system that is significantly more efficient and produces significantly better quality products. The system is more efficient because using one processing fluid for the workpiece and another processing fluid for the electrodes allows the processing fluids to be tailored to the best use in each area without having to compromise to mitigate the adverse effects of using only a single processing solution. As such, the tool does not need to be shut down as often to adjust the fluids and it consumes less constituents. The system produces better quality products because (a) using two different processing fluids allows better control of the concentration of important constituents in each processing fluid, and (b) using multiple electrodes provides better control of the current density at the surface of the workpiece.

DETAILED DESCRIPTION

As used herein, the terms "microfeature workpiece" or "workpiece" refer to substrates on and/or in which microdevices are formed. Typical microdevices include microelectronic circuits or components, thin-film recording heads, data storage elements, microfluidic devices, and other products. Micromachines or micromechanical devices are included within this definition because they are manufactured using much of the same technology as used in the fabrication of integrated circuits. The substrates can be semiconductive pieces (e.g., silicon wafers or gallium arsenide wafers), nonconductive pieces (e.g., various ceramic substrates), or conductive pieces (e.g., doped wafers). Also, the term electrochemical processing or deposition includes electroplating, electro-etching, anodization, and/or electroless plating.

Several embodiments of electrochemical deposition chambers for processing microfeature workpieces are particularly useful for electrolytically depositing metals or electrophoretic resist in or on structures of a workpiece. The electrochemical deposition chambers in accordance with the invention can accordingly be used in systems with wet chemical processing chambers for etching, rinsing, or other types of wet chemical processes in the fabrication of microfeatures in and/or on semiconductor substrates or other types of workpieces. Several embodiments of electrochemical deposition chambers and integrated tools in accordance with the invention are set forth in FIGS. 2A-13 and the corresponding text to provide a thorough understanding of particular embodiments of the invention. A person skilled in the art will understand, however, that the invention may have additional embodiments or that the invention may be practiced without several of the details of the embodiments shown in FIGS. 2A-13.

A. Embodiments of Wet Chemical Processing Systems

Figure 1:
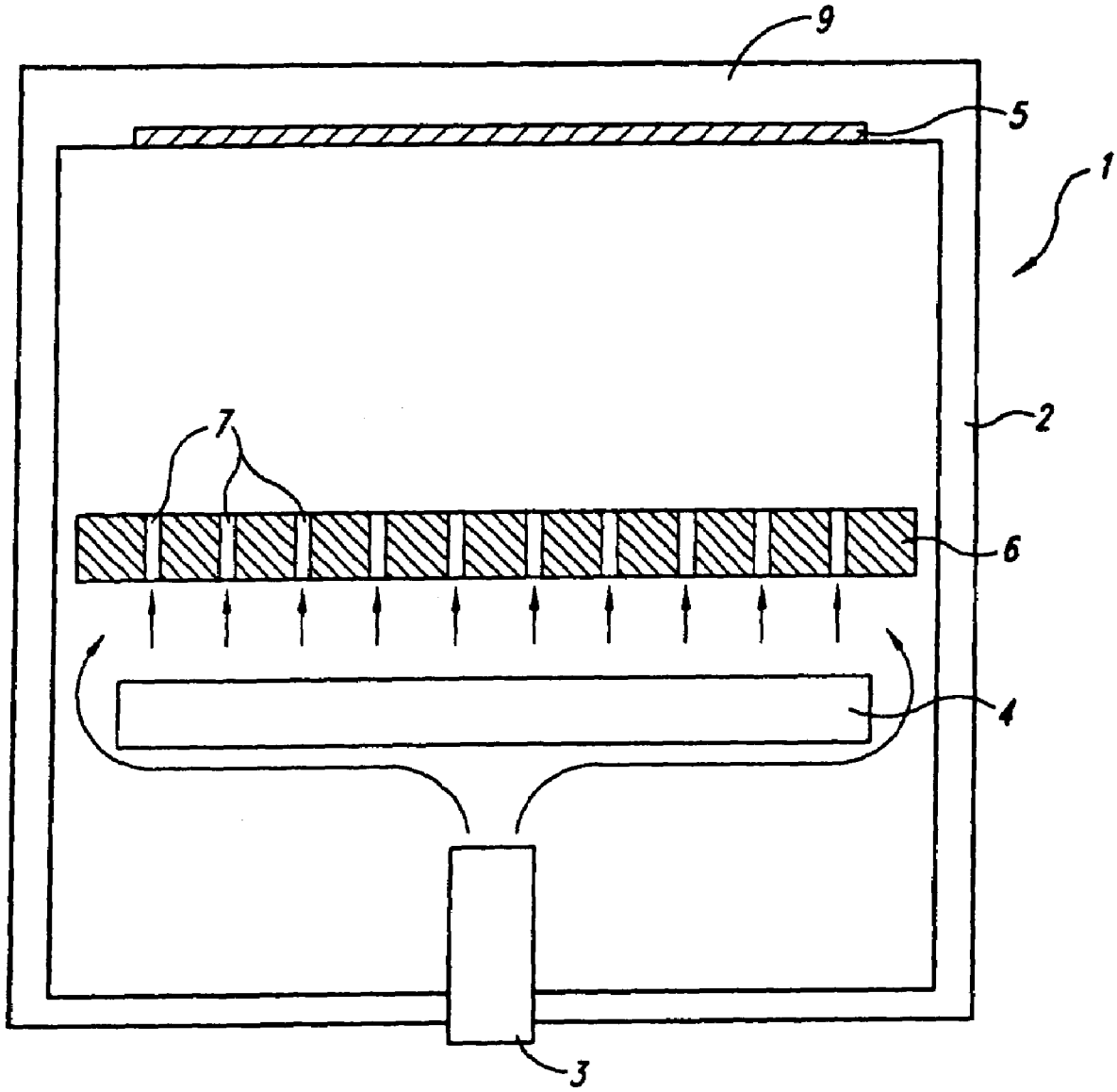
Fig. 1 (Prior Art)
FIG. 1 is a schematic diagram of an electroplating chamber in accordance with the prior art.
Figure 2A:
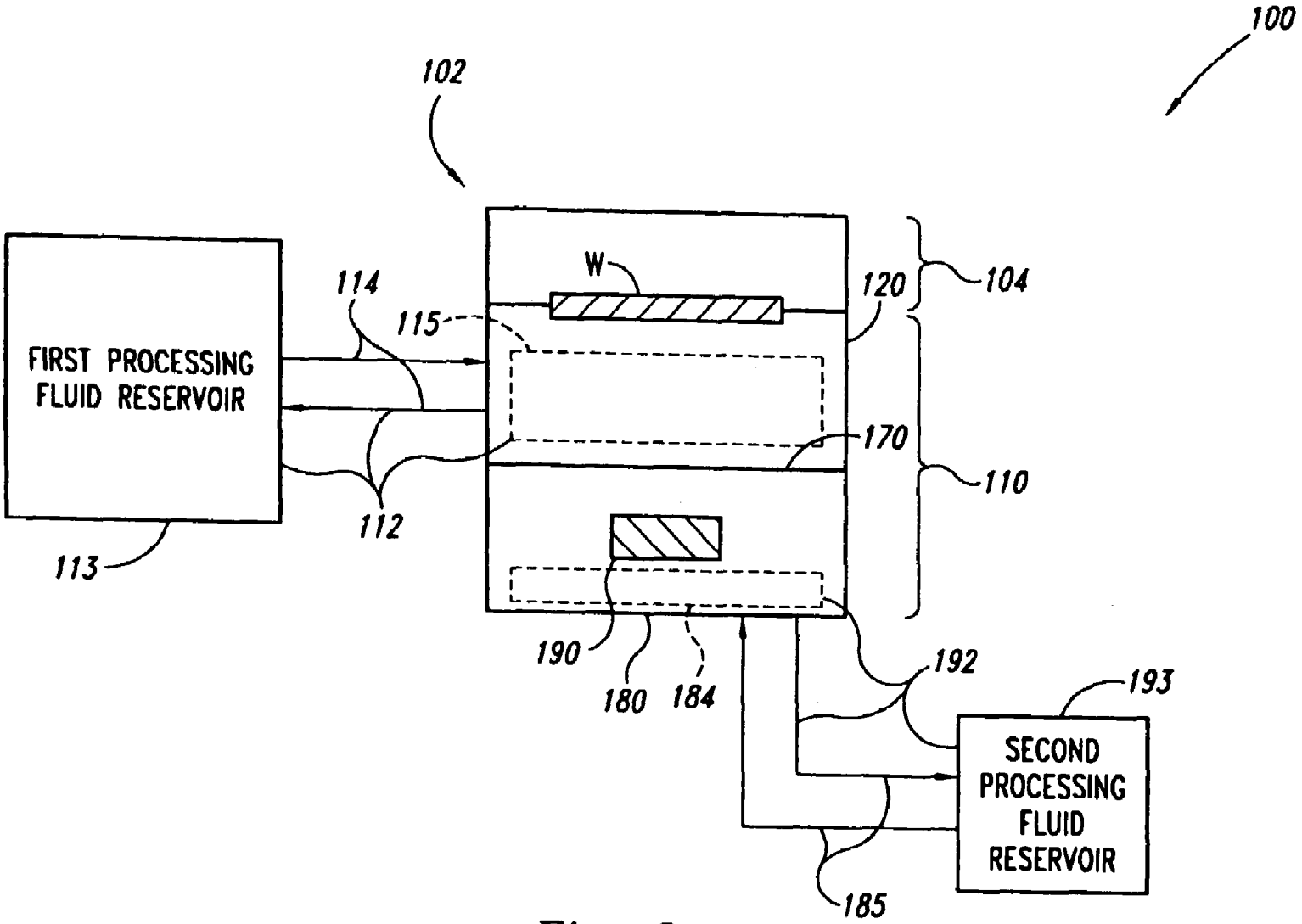
FIG. 2A schematically illustrates a system for electrochemical deposition, electropolishing, or other wet chemical processing of microfeature workpieces in accordance with one embodiment of the invention.

FIG. 2A schematically illustrates a system 100 for electrochemical deposition, electropolishing, or other wet chemical processing of microfeature workpieces. The system 100 includes an electrochemical deposition chamber 102 having a head assembly 104 (shown schematically) and a wet chemical vessel 110 (shown schematically). The head assembly 104 loads, unloads, and positions a workpiece W or a batch of workpieces at a processing site relative to the vessel 110. The head assembly 104 typically includes a workpiece holder having a contact assembly with a plurality of electrical contacts configured to engage a conductive layer on the workpiece W. The workpiece holder can accordingly apply an electrical potential to the conductive layer on the workpiece W. Suitable head assemblies, workpiece holders, and contact assemblies are disclosed in U.S. Pat. Nos. 6,228,232; 6,280,583; 6,303,010; 6,309,520; 6,309,524; 6,471,913; 6,527,925; and 6,569,297; and U.S. patent application Ser. Nos. 09/733,608 and 09/823,948, all of which are hereby incorporated by reference in their entirety.

The illustrated vessel 110 includes a processing unit 120 (shown schematically), an electrode unit 180 (shown schematically), and a nonporous barrier 170 (shown schematically) between the processing and electrode units 120 and 180. The processing unit 120 is configured to contain a first processing fluid for processing the microfeature workpiece W. The electrode unit 180 is configured to contain an electrode 190 and a second processing fluid at least proximate to the electrode 190. The second processing fluid is generally different than the first processing fluid, but they can be the same in some applications. In general, the first and second processing fluids have some ions in common. The first processing fluid in the processing unit 120 is a catholyte and the second processing fluid in the electrode unit 180 is an anolyte when the workpiece is cathodic. In electropolishing or other deposition processes, however, the first processing fluid can be an anolyte and the second processing fluid can be a catholyte.

The system 100 further includes a first flow system 112 that stores and circulates the first processing fluid and a second flow system 192 that stores and circulates the second processing fluid. The first flow system 112 may include a first processing fluid reservoir 113, a plurality of fluid conduits 114 to convey a flow of the first processing fluid between the first processing fluid reservoir 113 and the processing unit 120, and a plurality of components 115 (shown schematically) in the processing unit 120 to convey a flow of the first processing fluid between the processing site and the nonporous barrier 170. The second flow system 192 may include a second processing fluid reservoir 193, a plurality of fluid conduits 185 to convey the flow of the second processing fluid between the second processing fluid reservoir 193 and the electrode unit 180, and a plurality of components 184 (shown schematically) in the electrode unit 180 to convey the flow of the second processing fluid between the electrode 190 and the nonporous barrier 170. The concentrations of individual constituents of the first and second processing fluids can be controlled separately in the first and second processing fluid reservoirs 113 and 193, respectively. For example, metals, such as copper, can be added to the first and/or second processing fluid in the respective reservoir 113 or 193. Additionally, the temperature of the first and second processing fluids and/or removal of undesirable materials or bubbles can be controlled separately in the first and second flow systems 112 and 192.

The nonporous barrier 170 is positioned between the first and second processing fluids in the region of the interface between the processing unit 120 and the electrode unit 180 to separate and/or isolate the first processing fluid from the second processing fluid. For example, the nonporous barrier 170 inhibits fluid flow between the first and second flow systems 112 and 192 while selectively allowing ions, such as cations and/or anions, to pass through the barrier 170 between the first and second processing fluids. As such, an electrical field, a charge imbalance between the processing fluids, and/or differences in the concentration of substances in the processing fluids can drive ions across the nonporous barrier 170 as described in detail below.

In contrast to porous barriers, such as filter media, expanded Teflon (Goretex), and fritted materials (glass, quartz, ceramic, etc.), the nonporous barrier 170 inhibits non-ionic species, including small molecules and fluids, from passing through the barrier 170. For example, the nonporous barrier 170 can be substantially free of open area. Consequently, fluid is inhibited from passing through the nonporous barrier 170 when the first and second flow systems 112 and 192 operate at typical pressures. Water, however, can be transported through the nonporous barrier 170 via osmosis and/or electro-osmosis. Osmosis can occur when the molar concentrations in the first and second processing fluids are substantially different. Electro-osmosis can occur as water is carried through the nonporous barrier 170 with current carrying ions in the form of a hydration sphere. When the first and second processing fluids have similar molar concentrations and no electrical current is passed through the processing fluids, fluid flow between the first and second processing fluids is substantially prevented.

Moreover, the nonporous barrier 170 can be hydrophilic so that bubbles in the processing fluids do not cause portions of the barrier 170 to dry, which reduces conductivity through the barrier 170. Suitable nonporous barriers 170 include NAFION membranes manufactured by DuPont®, Ionac® membranes manufactured by Sybron Chemicals Inc., and NeoSepta membranes manufactured by Tokuyuma.

When the system 100 is used for electrochemical processing, an electrical potential can be applied to the electrode 190 and the workpiece W such that the electrode 190 is an anode and the workpiece W is a cathode. The first and second processing fluids are accordingly a catholyte and an anolyte, respectively, and each fluid can include a solution of metal ions to be plated onto the workpiece W. The electrical field between the electrode 190 and the workpiece W may drive positive ions through the nonporous barrier 170 from the anolyte to the catholyte, or drive negative ions in the opposite direction. In plating applications, an electrochemical reaction occurs at the microfeature workpiece W in which metal ions are reduced to form a solid layer of metal on the microfeature workpiece W. In electrochemical etching and other electrochemical applications, the electrical field may drive ions the opposite direction.

One feature of the system 100 illustrated in FIG. 2A is that the nonporous barrier 170 separates and isolates the first and second processing fluids from each other, but allows ions to pass between the first and second processing fluids. As such, the fluid in the processing unit 120 can have different chemical characteristics than the fluid in the electrode unit 180. For example, the first processing fluid can be a catholyte having organic additives and the second processing fluid can be an anolyte without organic additives or a much lower concentration of such additives. As explained above in the summary section, the lack of organic additives in the anolyte provides the following advantages: (a) reduces by-products of decomposed organics in the catholyte; (b) reduces consumption of the organic additives; (c) reduces passivation of the anode; and (d) enables efficient use of pure copper anodes.

The system 100 illustrated in FIG. 2A is also particularly efficacious in maintaining the desired concentration of copper ions or other metal ions in the first processing fluid. During the electroplating process, it is desirable to accurately control the concentration of materials in the first processing fluid to ensure consistent, repeatable depositions on a large number of individual microfeature workpieces. For example, when copper is deposited on the workpiece W, it is desirable to maintain the concentration of copper in the first processing fluid (e.g., the catholyte) within a desired range to deposit a suitable layer of copper on the workpiece W. This aspect of the system 100 is described in more detail below.

To control the concentration of metal ions in the first processing solution in some electroplating applications, the system 100 illustrated in FIG. 2A uses characteristics of the nonporous barrier 170, the volume of the first flow system 112, the volume of the second flow system 192, and the different acid concentrations in the first and second processing solutions. In general, the concentration of acid in the first processing fluid is greater than the concentration of acid in the second processing fluid, and the volume of the first processing fluid in the system 100 is greater than the volume of the second processing fluid in the system 100. As explained in more detail below, these features work together to maintain the concentration of the constituents in the first processing fluid within a desired range to ensure consistent and uniform deposition on the workpiece W. For purposes of illustration, the effect of increasing the concentration of acid in the first processing fluid will be described with reference to an embodiment in which copper is electroplated onto a workpiece. One skilled in the art will recognize that different metals can be electroplated and/or the principles can be applied to other wet chemical processes in other applications.

Figure 2B:
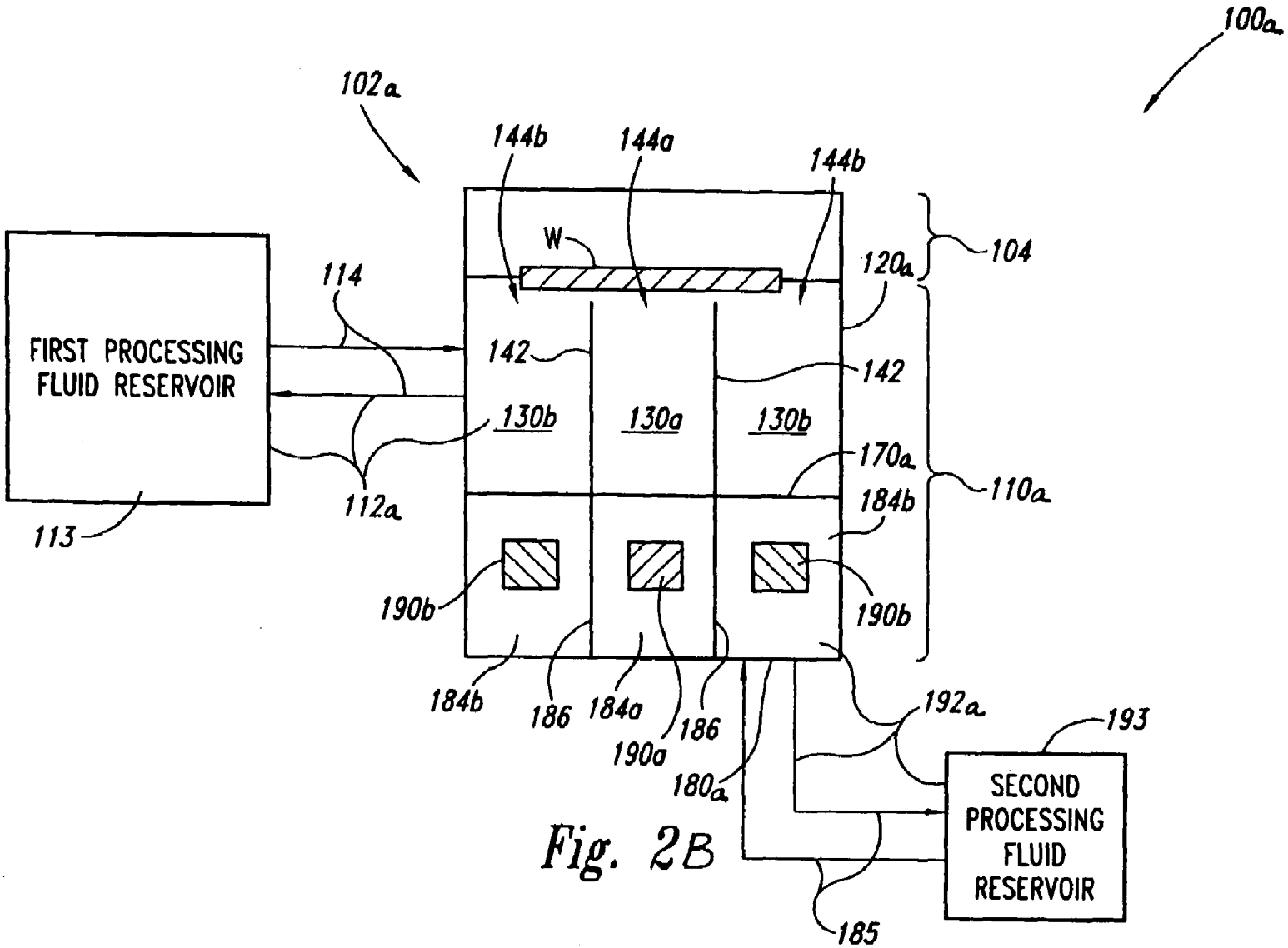
FIG. 2B schematically illustrates a system for electrochemical deposition, electropolishing, or other wet chemical processing of microfeature workpieces in accordance with another embodiment of the invention.

FIG. 2B schematically illustrates a system 100*a* for electrochemical deposition, electropolishing, or other wet chemical processing of microfeature workpieces in accordance with another embodiment of the invention. The system 100*a* is similar to the system 100 shown in FIG. 2A, and thus like reference numbers refer to like components in FIGS. 2A and 2B. The system 100*a* includes an electrochemical deposition chamber 102 having a head assembly 104 (shown schematically) and a wet chemical vessel 110*a* (shown schematically). The head assembly 104 loads, unloads, and positions a workpiece W or a batch of workpieces at a processing site relative to the vessel 110*a* as described above with reference to FIG. 2A.

The illustrated vessel 110*a* includes a processing unit 120*a* (shown schematically), an electrode unit 180*a* (shown schematically), and a barrier 170*a* (shown schematically) between the processing and electrode units 120*a* and 180*a*. The processing unit 120*a* of the illustrated embodiment includes a dielectric divider 142 projecting from the barrier 170*a* toward the processing site and a plurality of chambers 130 (identified individually as 130*a-b*) defined by the dielectric divider 142. The chambers 130*a-b* can be arranged concentrically and have corresponding openings 144*a-b* proximate to the processing site. The chambers 130*a-b* are configured to convey a first processing fluid to/from the microfeature workpiece W. The processing unit 120*a*, however, may not include the dielectric divider 142 and the chambers 130, or the dielectric divider 142 and the chambers 130 may have other configurations.

The electrode unit 180*a* includes a dielectric divider 186, a plurality of compartments 184*a-b* defined by the dielectric divider 186, and a plurality of electrodes 190*a* and 190*b* disposed within corresponding compartments 184*a-b*. The compartments 184*a-b* can be arranged concentrically and configured to convey a second processing fluid at least proximate to the electrodes 190*a-b*. As noted above, the second processing fluid is generally different than the first processing fluid, but they can be the same in some applications. In general, the first and second processing fluids have some ions in common. The first processing fluid in the processing unit 120*a* is a catholyte and the second processing fluid in the electrode unit 180*a* is an anolyte when the workpiece is cathodic. In electropolishing or other deposition processes, however, the first processing fluid can be an anolyte and the second processing fluid can be a catholyte. Although the system 100*a* shown in FIG. 2B includes two concentric electrodes 190*a-b*, in other embodiments, systems can include a different number of electrodes and/or the electrodes can be arranged in a different configuration.

The system 100*a* further includes a first flow system 112*a* that stores and circulates the first processing fluid and a second flow system 192*a* that stores and circulates the second processing fluid. The first flow system 112*a* may include (a) the first processing fluid reservoir 113, (b) the plurality of fluid conduits 114 to convey the flow of the first processing fluid between the first processing fluid reservoir 113 and the processing unit 120*a*, and (c) the chambers 130*a-b* to convey the flow of the first processing fluid between the processing site and the barrier 170*a*. The second flow system 192*a* may include (a) the second processing fluid reservoir 193, (b) the plurality of fluid conduits 185 to convey the flow of the second processing fluid between the second processing fluid reservoir 193 and the electrode unit 180*a*, and (c) the compartments 184*a-b* to convey the flow of the second processing fluid between the electrodes 190*a-b* and the barrier 170*a*. The concentrations of individual constituents of the first and second processing fluids can be controlled separately in the first and second processing fluid reservoirs 113 and 193, respectively. For example, metals, such as copper, can be added to the first and/or second processing fluid in the respective reservoir 113 or 193. Additionally, the temperature of the first and second processing fluids and/or removal of undesirable materials or bubbles can be controlled separately in the first and second flow systems 112*a* and 192*a*.

The barrier 170*a* is positioned between the first and second processing fluids in the region of the interface between the processing unit 120*a* and the electrode unit 180*a* to separate and/or isolate the first processing fluid from the second processing fluid. For example, the barrier 170*a* can be a porous, permeable membrane that permits fluid and small molecules to flow through the barrier 170*a* between the first and second processing fluids. Alternatively, the barrier 170*a* can be a nonporous, semipermeable membrane that prevents fluid flow between the first and second flow systems 112 and 192 while selectively allowing ions, such as cations and/or anions, to pass through the barrier 170*a* between the first and second processing fluids, as described above with respect to the nonporous barrier 170 shown in FIG. 2A. In either case, the barrier 170*a* restricts bubbles, particles, and large molecules such as organic additives from passing between the first and second processing fluids.

When the system 100*a* is used for electrochemical processing, an electrical potential can be applied to the electrodes 190*a-b* and the workpiece W such that the electrodes 190*a-b* are anodes and the workpiece W is a cathode. The first and second processing fluids are accordingly a catholyte and an anolyte, respectively, and each fluid can include a solution of metal ions to be plated onto the workpiece W. The electrical field between the electrodes 190*a-b* and the workpiece W may drive positive ions through the barrier 170*a* from the anolyte to the catholyte, or drive negative ions in the opposite direction. In plating applications, an electrochemical reaction occurs at the microfeature workpiece W in which metal ions are reduced to form a solid layer of metal on the microfeature workpiece W. In electrochemical etching and other electrochemical applications, the electrical field may drive ions the opposite direction.

The first electrode 190*a* provides an electrical field to the workpiece W at the processing site through the portion of the second processing fluid in the first compartment 184*a* of the electrode unit 180*a* and the portion of the first processing fluid in the first chamber 130*a* of the processing unit 120*a*. Accordingly, the first electrode 190*a* provides an electrical field that is effectively exposed to the processing site via the first opening 144*a*. The first opening 144*a* shapes the electrical field of the first electrode 190*a* to create a "virtual electrode" at the top of the first opening 144*a*. This is a "virtual electrode" because the dielectric divider 142 shapes the electrical field of the first electrode 190*a* so that the effect is as if the first electrode 190*a* were placed in the first opening 144*a*. Virtual electrodes are described in detail in U.S. patent application Ser. No. 09/872,151, incorporated by reference above. Similarly, the second electrode 190*b* provides an electrical field to the workpiece W through the portion of the second processing fluid in the second compartment 184*b* of the electrode unit 180*a* and the portion of the first processing fluid in the second chamber 130*b* of the processing unit 120*a*. Accordingly, the second electrode 190*b* provides an electrical field that is effectively exposed to the processing site via the second opening 144*b* to create another "virtual electrode."

In operation, a first current is applied to the first electrode 190*a* and a second current is applied to the second electrode 190*b*. The first and second electrical currents are controlled independently of each other such that they can be the same or different than each other at any given time. Additionally, the first and second electrical currents can be dynamically varied throughout a plating cycle. The first and second electrodes accordingly provide a highly controlled electrical field to compensate for inconsistent or non-uniform seed layers as well as changes in the plated layer during a plating cycle.

In addition to the benefits of having multiple independently operable electrodes, the system 100*a* is expected to have similar benefits as the system 100 described above with respect to separating the first processing fluid from the second processing fluid. As explained above, for example, the lack of organic additives in the anolyte provides the following advantages: (a) reduces by-products of decomposed organics in the catholyte; (b) reduces consumption of the organic additives; (c) reduces passivation of the anode; and (d) enables efficient use of pure copper anodes. The system 100*a* illustrated in FIG. 2B is also expected to be particularly efficacious in maintaining the desired concentration of copper ions or other metal ions in the first processing fluid for the reasons described in more detail below.

B. Operation of Electrochemical Deposition Systems

FIGS. 3A-3H graphically illustrate the relationship between the concentrations of hydrogen and copper ions in the anolyte and catholyte for the systems 100 and 100*a* during a plating cycle and during an idle period. The following description regarding FIGS. 3A-3H, more specifically, describes several embodiments of operating the system 100 shown in FIG. 2A for purposes of brevity. The operation of the anolyte and catholyte in the system 100*a* can be substantially similar or even identical to the operation of these features in the system 100. As such, the following description also applies to the system 100*a* shown in FIG. 2B.

Figure 3A:
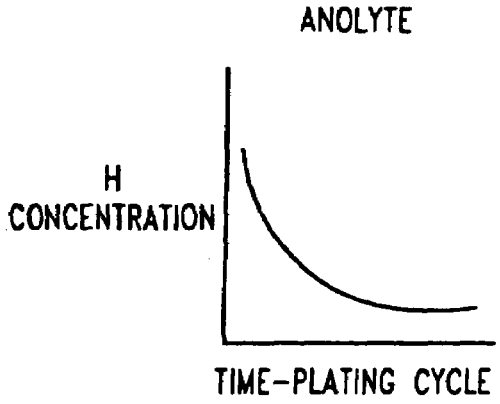
FIGS. 3A-3H graphically illustrate the relationship between the concentration of hydrogen and copper ions in an anolyte and a catholyte during a plating cycle and while the systems of FIGS. 2A and 2B are idle in accordance with one embodiment of the invention.
Figure 3B:
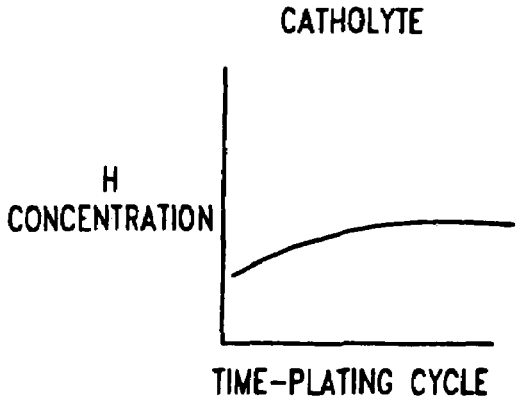

FIGS. 3A and 3B show the concentration of hydrogen ions in the second processing fluid (anolyte) and the first processing fluid (catholyte), respectively, during a plating cycle. The electrical field readily drives hydrogen ions across the nonporous barrier 170 (FIG. 2A) from the anolyte to the catholyte during the plating cycle. Consequently, the concentration of hydrogen ions decreases in the anolyte and increases in the catholyte. As measured by percent concentration change or molarity, the decrease in the concentration of hydrogen ions in the anolyte is generally significantly greater than the corresponding increase in the concentration of hydrogen ions in the catholyte because: (a) the volume of catholyte in the illustrated system 100 is greater than the volume of anolyte; and (b) the concentration of hydrogen ions in the catholyte is much higher than in the anolyte.

Figure 3C:
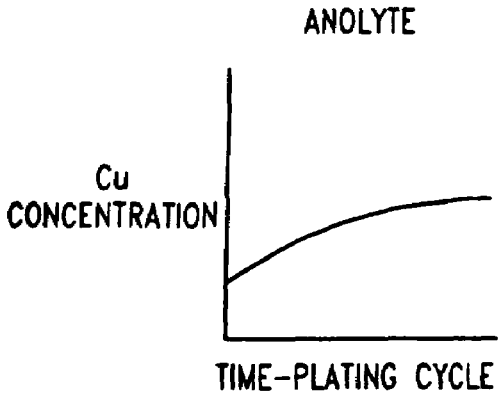
Figure 3D:
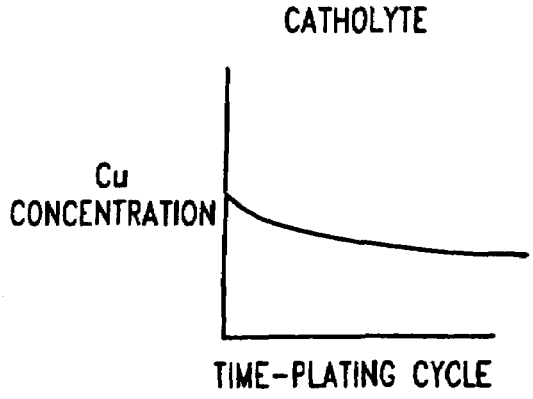

FIGS. 3C and 3D graphically illustrate the concentration of copper ions in the anolyte and catholyte during the plating cycle. During the plating cycle, the anode replenishes copper ions in the anolyte and the electrical field drives the copper ions across the nonporous barrier 170 from the anolyte to the catholyte. The anode replenishes copper ions to the anolyte during the plating cycle. Thus, as shown in FIG. 3C, the concentration of copper ions in the anolyte increases during the plating cycle. Conversely, in the catholyte cell, FIG. 3D shows that the concentration of copper ions in the catholyte initially decreases during the plating cycle as the copper ions are consumed to form a layer on the microfeature workpiece W.

Figure 3E:
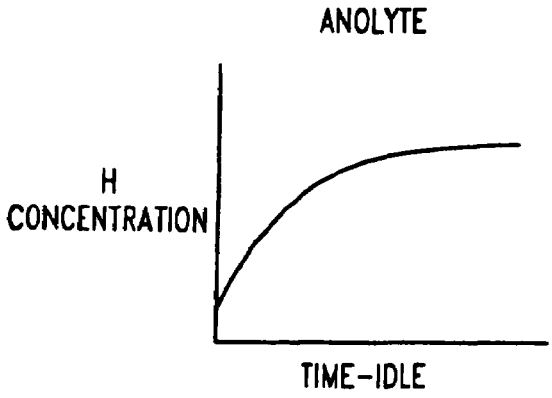
Figure 3F:
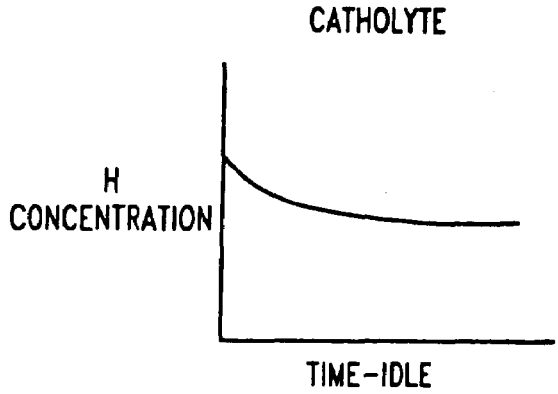
Figure 3G:
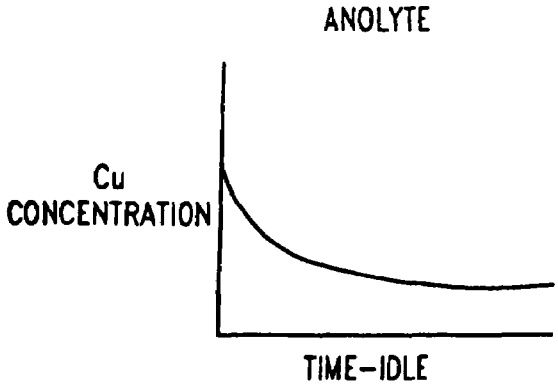
Figure 3H:
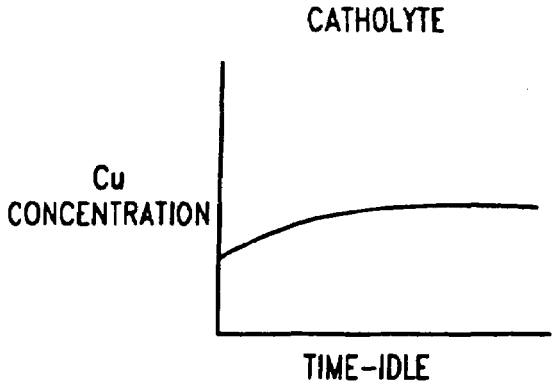

FIGS. 3E-3H graphically illustrate the concentration of hydrogen and copper ions in the anolyte and the catholyte while the system 100 of FIG. 2A is idle. For example, FIGS. 3E and 3F illustrate that the concentration of hydrogen ions increases in the anolyte and decreases in the catholyte while the system 100 is idle because the greater concentration of acid in the catholyte drives hydrogen ions across the nonporous barrier 170 to the anolyte. FIGS. 3G and 3H graphically illustrate that the concentration of copper ions decreases in the anolyte and increases in the catholyte while the system 100 is idle. The movement of hydrogen ions into the anolyte creates a charge imbalance that drives copper ions from the anolyte to the catholyte. Accordingly, one feature of the illustrated embodiment is that when the system 100 is idle, the catholyte is replenished with copper because of the difference in the concentration of acid in the anolyte and catholyte. An advantage of this feature is that the desired concentration of copper in the catholyte can be maintained while the system 100 is idle. Another advantage of this feature is that the increased movement of copper ions across the nonporous barrier 170 prevents saturation of the anolyte with copper, which can cause passivation of the anode and/or the formation of salt crystals.

The foregoing operation of the system 100 shown in FIG. 2A occurs, in part, by selecting suitable concentrations of hydrogen ions (i.e., acid protons) and copper. In several useful processes for depositing copper, the acid concentration in the first processing fluid can be approximately 10 g/l to approximately 200 g/l, and the acid concentration in the second processing fluid can be approximately 0.1 g/l to approximately 1.0 g/l. Alternatively, the acid concentration of the first and/or second processing fluids can be outside of these ranges. For example, the first processing fluid can have a first concentration of acid and the second processing fluid can have a second concentration of acid less than the first concentration. The ratio of the first concentration of acid to the second concentration of acid, for example, can be approximately 10:1 to approximately 20,000:1. The concentration of copper is also a parameter. For example, in many copper plating applications, the first and second processing fluids can have a copper concentration of between approximately 10 g/l and approximately 50 g/l. Although the foregoing ranges are useful for many applications, it will be appreciated that the first and second processing fluids can have other concentrations of copper and/or acid.

In other embodiments, the nonporous barrier can be anionic and the electrode can be an inert anode (i.e. platinum or iridium oxide) to prevent the accumulation of sulfate ions in the first processing fluid. In this embodiment, the acid concentration or pH in the first and second processing fluids can be similar. Alternatively, the second processing fluid may have a higher concentration of acid to increase the conductivity of the fluid. Copper salt (copper sulfate) can be added to the first processing fluid to replenish the copper in the fluid. Electrical current can be carried through the barrier by the passage of sulfate anions from the first processing fluid to the second processing fluid. Therefore, sulfate ions are less likely to accumulate in the first processing fluid where they can adversely affect the deposited film.

In other embodiments, the system can electrochemically etch copper from the workpiece. In these embodiments, the first processing solution (the anolyte) contains an electrolyte that may include copper ions. During electrochemical etching, a potential can be applied to the electrode and/or the workpiece. An anionic nonporous barrier can be used to prevent positive ions (such as copper) from passing into the second processing fluid (catholyte). Consequently, the current is carried by anions, and copper ions are inhibited from flowing proximate to and being deposited on the electrode.

The foregoing operation of the illustrated system 100 also occurs by selecting suitable volumes of anolyte and catholyte. Referring back to FIG. 2A, another feature of the illustrated system 100 is that it has a first volume of the first processing fluid and a second volume of the second processing fluid in the corresponding processing fluid reservoirs 113 and 193 and flow systems 112 and 192. The ratio between the first volume and the second volume can be approximately 1.5:1 to 20:1, and in many applications is approximately 2:1, 3:1, 4:1, 5:1, 6:1, 7:1, 8:1, 9:1 or 10:1. The difference in volume in the first and second processing fluids moderates the change in the concentration of materials in the first processing fluid. For example, as described above with reference to FIGS. 3A and 3B, when hydrogen ions move from the anolyte to the catholyte, the percentage change in the concentration of hydrogen ions in the catholyte is less than the change in the concentration of hydrogen ions in the anolyte because the volume of catholyte is greater than the volume of anolyte. In other embodiments, the first and second volumes can be approximately the same.

C. Embodiments of Electrochemical Deposition Vessels

Figure 4:
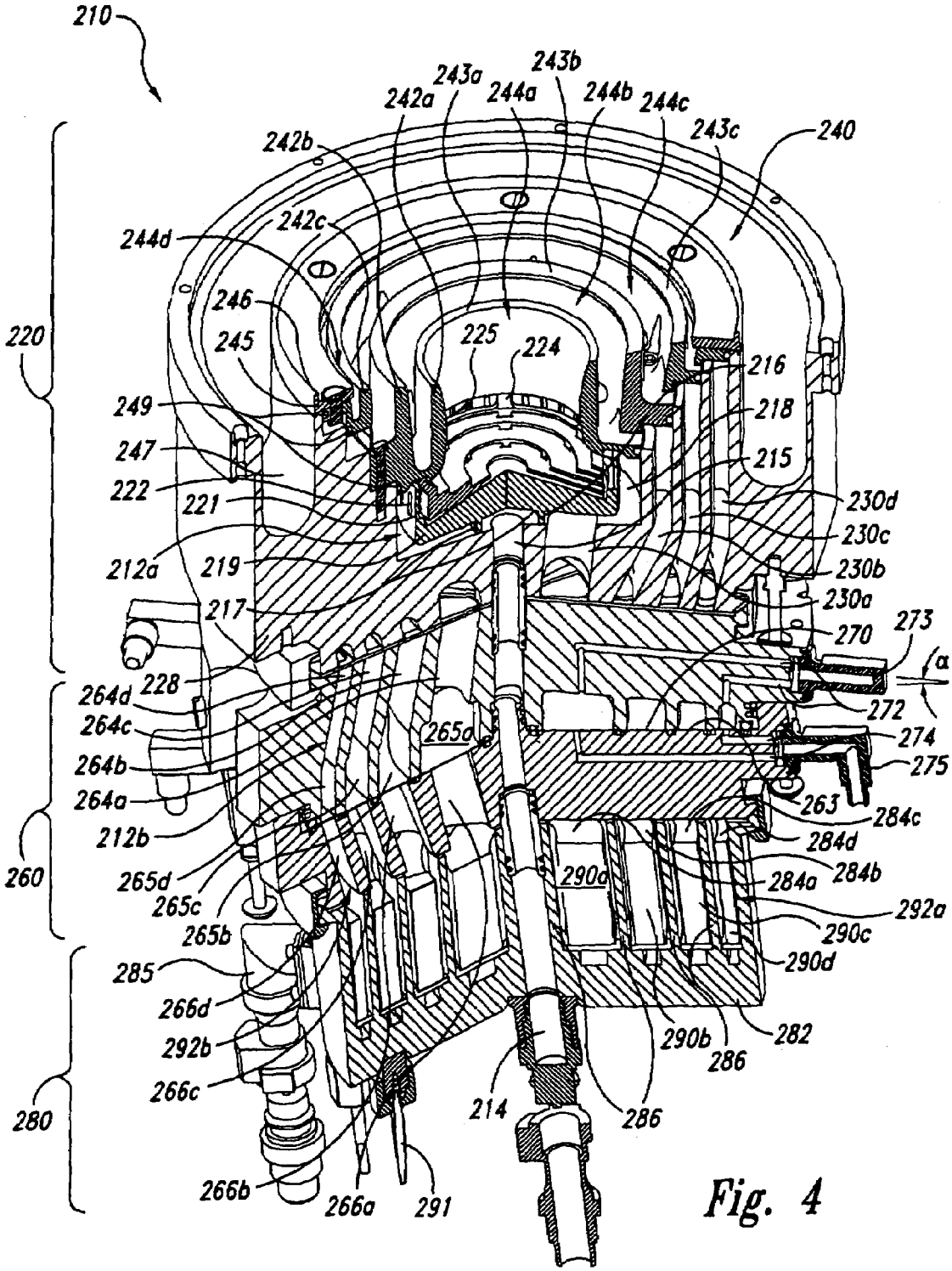
FIG. 4 is a schematic isometric view showing cross-sectional portions of a wet chemical vessel in accordance with another embodiment of the invention.

FIG. 4 is an isometric view showing cross-sectional portions of a wet chemical vessel 210 in accordance with another embodiment of the invention. The vessel 210 is configured to be used in a system similar to the systems 100 and 100*a* (FIGS. 2A and 2B) for electrochemical deposition, electropolishing, anodization, or other wet chemical processing of microfeature workpieces. The vessel 210 shown in FIG. 4 is accordingly one example of the type of vessel 110 or 110*a*. As such, the vessel 210 can be coupled to a first processing fluid reservoir (not shown) so that a first flow system (partially shown as 212*a-b*) can provide a first processing fluid to a workpiece for processing. The vessel 210 can also be coupled to a second processing fluid reservoir (not shown) so that a second flow system (partially shown as 292*a-b*) can convey a second processing fluid proximate to an electrode(s).

The illustrated vessel 210 includes a processing unit 220, a barrier unit 260 coupled to the processing unit 220, and an electrode unit 280 coupled to the barrier unit 260. The processing unit 220, the barrier unit 260, and the electrode unit 280 need not be separate units, but rather they can be sections or components of a single unit. The processing unit 220 includes a chassis 228 having a first portion of the first flow system 212*a* to direct the flow of the first processing fluid through the chassis 228. The first portion of the first flow system 212*a* can include a separate component attached to the chassis 228 and/or a plurality of fluid passageways in the chassis 228. In this embodiment, the first portion of the first flow system 212*a* includes a conduit 215, a first flow guide 216 having a plurality of slots 217, and an antechamber 218. The slots 217 in the first flow guide 216 distribute the flow radially to the antechamber 218.

The first portion of the first flow system 212*a* further includes a second flow guide 219 that receives the flow from the antechamber 218. The second flow guide 219 can include a sidewall 221 having a plurality of openings 222 and a flow projector 224 having a plurality of apertures 225. The openings 222 can be vertical slots arranged radially around the sidewall 221 to provide a plurality of flow components projecting radially inwardly toward the flow projector 224. The apertures 225 in the flow projector 224 can be a plurality of elongated slots or other openings that are inclined upwardly and radially inwardly. The flow projector 224 receives the radial flow components from the openings 222 and redirects the flow through the apertures 225. It will be appreciated that the openings 222 and the apertures 225 can have several different configurations. For example, the apertures 225 can project the flow radially inwardly without being canted upwardly, or the apertures 225 can be canted upwardly at a greater angle than the angle shown in FIG. 4. The apertures 225 can accordingly be inclined at an angle ranging from approximately 0°-45°, and in several specific embodiments the apertures 225 can be canted upwardly at an angle of approximately 5°-25°.

The processing unit 220 can also include a field shaping module 240 for shaping the electrical field(s) and directing the flow of the first processing fluid at the processing site. In this embodiment, the field shaping module 240 has a first partition 242*a* with a first rim 243*a*, a second partition 242*b* with a second rim 243*b*, and a third partition 242*c* with a third rim 243*c*. The first rim 243*a* defines a first opening 244*a*, the first rim 243*a* and the second rim 243*b* define a second opening 244*b*, and the second rim 243*b* and the third rim 243*c* define a third opening 244*c*. The processing unit 220 can further include a weir 245 having a rim 246 over which the first processing fluid can flow into a recovery channel 247. The third rim 243*c* and the weir 245 define a fourth opening 244*d*. The field shaping module 240 and the weir 245 are attached to the processing unit 220 by a plurality of bolts or screws, and a number of seals 249 are positioned between the chassis 228 and the field shaping module 240.

The vessel 210 is not limited to having the field shaping unit 240 shown in FIG. 4. In other embodiments, field shaping units can have other configurations. For example, a field shaping unit can have a first dielectric member defining a first opening and a second dielectric member defining a second opening above the first opening. The first opening can have a first area and the second opening can have a second area different than the first area. The first and second openings may also have different shapes.

In the illustrated embodiment, the first portion of the first flow system 212*a* in the processing unit 220 further includes a first channel 230*a* in fluid communication with the antechamber 218, a second channel 230*b* in fluid communication with the second opening 244*b*, a third channel 230*c* in fluid communication with the third opening 244*c*, and a fourth channel 230*d* in fluid communication with the fourth opening 244*d*. The first portion of the first flow system 212*a* can accordingly convey the first processing fluid to the processing site to provide a desired fluid flow profile at the processing site.

In this particular processing unit 220, the first processing fluid enters through an inlet 214 and passes through the conduit 215 and the first flow guide 216. The first processing fluid flow then bifurcates with a portion of the fluid flowing up through the second flow guide 219 via the antechamber 218 and another portion of the fluid flowing down through the first channel 230*a* of the processing unit 220 and into the barrier unit 260. The upward flow through the second flow guide 219 passes through the flow projector 224 and the first opening 244*a*. A portion of the first processing fluid flow passes upwardly over the rim 243*a*, through the processing site proximate to the workpiece, and then flows over the rim 246 of the weir 245. Other portions of the first processing fluid flow downwardly through each of the channels 230*b-d* of the processing unit 220 and into the barrier unit 260.

The electrode unit 280 of the illustrated vessel 210 includes a container 282 that houses an electrode assembly and a first portion of the second flow system 292*a*. The illustrated container 282 includes a plurality of dividers or walls 286 that define a plurality of compartments 284 (identified individually as 284*a-d*). The walls 286 of this container 282 are concentric annular dividers that define annular compartments 284. However, in other embodiments, the walls can have different configurations to create nonannular compartments and/or each compartment can be further divided into cells. The specific embodiment shown in FIG. 4 has four compartments 284, but in other embodiments, the container 282 can include any number of compartments to house the electrode(s). The compartments 284 can also define part of the first portion of the second flow system 292*a* through which the second processing fluid flows.

The vessel 210 can further include at least one electrode disposed in the electrode unit 280. The vessel 210 shown in FIG. 4 includes a first electrode 290*a* in a first compartment 284*a*, a second electrode 290*b* in a second compartment 284*b*, a third electrode 290*c* in a third compartment 284*c*, and a fourth electrode 290*d* in a fourth compartment 284*d*. The electrodes 290*a-d* can be annular or circular conductive elements arranged concentrically with one another. In other embodiments, the electrodes can be arcuate segments or have other shapes and arrangements. Although four electrodes 290 are shown in the illustrated embodiment, other embodiments can include a different number of electrodes, including a single electrode, two electrodes, etc.

In this embodiment, the electrodes 290 are coupled to an electrical connector system 291 that extends through the container 282 of the electrode unit 280 to couple the electrodes 290 to a power supply. The electrodes 290 can provide a constant current throughout a plating cycle, or the current through one or more of the electrodes 290 can be changed during a plating cycle according to the particular parameters of the workpiece. Moreover, each electrode 290 can have a unique current that is different than the current of the other electrodes 290. The electrodes 290 can be operated in DC, pulsed, and pulse reverse waveforms. Suitable processes for operating the electrodes are set forth in U.S. patent application Ser. Nos. 09/849,505; 09/866,391; and 09/866,463, all of which are hereby incorporated by reference in their entirety.

The first portion of the second flow system 292*a* conveys the second processing fluid through the electrode unit 280. More specifically, the second processing fluid enters the electrode unit 280 through an inlet 285 and then the flow is divided as portions of the second processing fluid flow into each of the compartments 284. The portions of the second processing fluid flow across corresponding electrodes 290 as the fluid flows through the compartments 284 and into the barrier unit 260.

The illustrated barrier unit 260 is between the processing unit 220 and the electrode unit 280 to separate the first processing fluid from the second processing fluid while allowing individual electrical fields from the electrodes 290 to act through the openings 244*a-d*. The barrier unit 260 includes a second portion of the first flow system 212*b*, a second portion of the second flow system 292*b*, and a nonporous barrier 270 separating the first processing fluid in the first flow system 212 from the second processing fluid in the second flow system 292. The second portion of the first flow system 212*b* is in fluid communication with the first portion of the first flow system 212*a* in the processing unit 220. The second portion of the first flow system 212*b* includes a plurality of annular openings 265 (identified individually as 265*a-d*): adjacent to the nonporous barrier 270, a plurality of channels 264 (identified individually as 264*a-d*) extending between corresponding annular openings 265 and corresponding channels 230 in the processing unit 220, and a plurality of passageways 272 extending between corresponding annular openings 265 and a first outlet 273. As such, the first processing fluid flows from the channels 230*a-d* of the processing unit 220 to corresponding channels 264*a-d* of the barrier unit 260. After flowing through the channels 264*a-d* in the barrier unit 260, the first processing fluid flows in a direction generally parallel to the nonporous barrier 270 through the corresponding annular openings 265 to corresponding passageways 272. The first processing fluid flows through the passageways 272 and exits the vessel 210 via the first outlet 273.

The second portion of the second flow system 292*b* is in fluid communication with the first portion of the second flow system 292*a* in the electrode unit 280. The second portion of the second flow system 292*b* includes a plurality of channels 266 (identified individually as 266*a-d*) extending between the barrier 270 and corresponding compartments 284 in the electrode unit 280 and a plurality of passageways 274 extending between the nonporous barrier 270 and a second outlet 275. As such, the second processing fluid flows from the compartments 284*a-d* to corresponding channels 266*a-d* and against the nonporous barrier 270. The second processing fluid flow flexes the nonporous barrier 270 toward the processing unit 220 so that the fluid can flow in a direction generally parallel to the barrier 270 between the barrier 270 and a surface 263 of the barrier unit 260 to the corresponding passageways 274. The second processing fluid flows through the passageways 274 and exits the vessel 210 via the second outlet 275.

The nonporous barrier 270 is disposed between the second portion of the first flow system 212*b* and the second portion of the second flow system 292*b* to separate the first and second processing fluids. The nonporous barrier 270 can be a semi-permeable membrane to inhibit fluid flow between the first and second flow systems 212 and 292 while allowing ions to pass through the barrier 270 between the first and second processing fluids. As explained above, the nonporous barrier 270 can also be cation or anion selective and accordingly permit only the selected ions to pass through the barrier 270. Because fluids are inhibited from flowing through the nonporous barrier 270, the barrier 270 is not subject to clogging.

Electrical current can flow through the nonporous barrier 270 in either direction in the presence of an electrolyte. For example, electrical current can flow from the second processing fluid in the channels 266 to the first processing fluid in the annular openings 265. Furthermore, the nonporous barrier 270 can be hydrophilic so that bubbles in the processing fluids do not cause portions of the barrier 270 to become dry and block electrical current. The nonporous barrier 270 shown in FIG. 4 is also flexible to permit the second processing fluid to flow from the channels 266 laterally (e.g., annularly) between the barrier 270 and the surface 263 of the barrier unit 260 to the corresponding passageway 274. The nonporous barrier 270 can flex upwardly when the second processing fluid exerts a greater pressure against the barrier 270 than the first processing fluid.

The vessel 210 also controls bubbles that are formed at the electrodes 290 or elsewhere in the system. For example, the nonporous barrier 270, a lower portion of the barrier unit 260, and the electrode unit 280 are canted relative to the processing unit 220 to prevent bubbles in the second processing fluid from becoming trapped against the barrier 270. As bubbles in the second processing fluid move upward through the compartments 284 and the channels 266, the angled orientation of the nonporous barrier 270 and the bow of the barrier 270 above each channel 266 causes the bubbles to move laterally under the barrier 270 toward the upper side of the surface 263 corresponding to each channel 266. The passageways 274 carry the bubbles out to the second outlet 275 for removal. The illustrated nonporous barrier 270 is oriented at an angle $\alpha$ of approximately 5°. In additional embodiments, the barrier 270 can be oriented at an angle greater than or less than 5° that is sufficient to remove bubbles. The angle $\alpha$, accordingly, is not limited to 5°. In general, the angle $\alpha$ should be large enough to cause bubbles to migrate to the high side, but not so large that it adversely affects the electrical field.

An advantage of the illustrated barrier unit 260 is that the angle $\alpha$ of the nonporous barrier 270 prevents bubbles from being trapped against portions of the barrier 270 and creating dielectric areas on the barrier 270, which would adversely affect the electrical field. In other embodiments, other devices can be used to degas the processing fluids in lieu of or in addition to canting the barrier 270. As such, the nonporous barrier 270 need not be canted relative to the processing unit 220 in all applications.

The spacing between the electrodes 290 and the nonporous barrier 270 is another design criteria for the vessel 210. In the illustrated vessel 210, the distance between the nonporous barrier 270 and each electrode 290 is approximately the same. For example, the distance between the nonporous barrier 270 and the first electrode 290*a* is approximately the same as the distance between the nonporous barrier 270 and the second electrode 290*b*. Alternatively, the distance between the nonporous barrier 270 and each electrode 290 can be different. In either case, the distance between the nonporous barrier 270 and each arcuate section of a single electrode 290 is approximately the same. The uniform spacing between each section of a single electrode 290 and the nonporous barrier 270 is expected to provide more accurate control over the electrical field compared to having different spacings between sections of an electrode 290 and the barrier 270. Because the second processing fluid has less acid, and is thus less conductive, a difference in the distance between the nonporous barrier 270 and separate sections of an individual electrode 290 has a greater affect on the electrical field at the workpiece than a difference in the distance between the workpiece and the barrier 270.

In operation, the processing unit 220, the barrier unit 260, and the electrode unit 280 operate together to provide a desired electrical field profile (e.g., current density) at the workpiece. The first electrode 290*a* provides an electrical field to the workpiece through the portions of the first and second processing fluids that flow in the first channels 230*a*, 264*a*, and 266*a*, and the first compartment 284*a*. Accordingly, the first electrode 290*a* provides an electrical field that is effectively exposed to the processing site via the first opening 244*a*. The first opening 244*a* shapes the electrical field of the first electrode 290*a* according to the configuration of the rim 243*a* of the first partition 242*a* to create a "virtual electrode" at the top of the first opening 244*a*. This is a "virtual electrode" because the field shaping module 240 shapes the electrical field of the first electrode 290*a* so that the effect is as if the first electrode 290*a* were placed in the first opening 244*a*. Virtual electrodes are described in detail in U.S. patent application Ser. No. 09/872,151, which is hereby incorporated by reference. Similarly, the second, third, and fourth electrodes 290*b-d* provide electrical fields to the processing site through the portions of the first and second processing fluids that flow in the second channels 230*b*, 264*b*, and 266*b*, the third channels 230*c*, 264*c*, and 266*c*, and the fourth channels 230*d*, 264*d*, and 266*d*, respectively. Accordingly, the second, third, and fourth electrodes 290*b-d* provide electrical fields that are effectively exposed to the processing site via the second, third, and fourth openings 244*b-d*, respectively, to create corresponding virtual electrodes.

Figure 5:
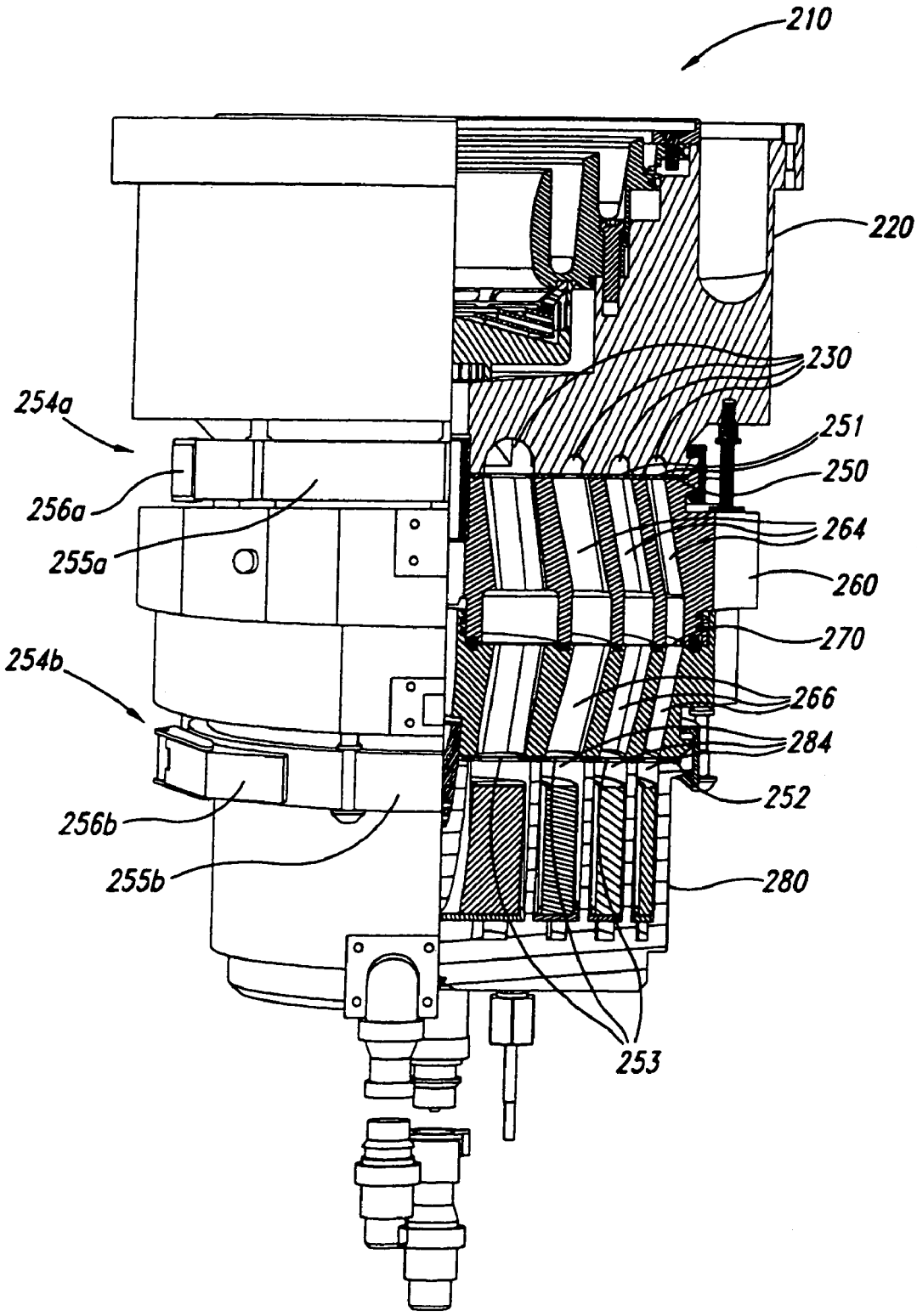
FIG. 5 is a schematic side view showing a cross-sectional, side portion of the vessel of FIG. 4.

FIG. 5 is a schematic side view showing a cross-sectional side portion of the wet chemical vessel 210 of FIG. 4. The illustrated vessel 210 further includes a first interface element 250 between the processing unit 220 and the barrier unit 260 and a second interface element 252 between the barrier unit 260 and the electrode unit 280. In this embodiment, the first interface element 250 is a seal having a plurality of openings 251 to allow fluid communication between the channels 230 of the processing unit 220 and the corresponding channels 264 of the barrier unit 260. The seal is a dielectric material that electrically insulates the electrical fields within the corresponding channels 230 and 264. Similarly, the second interface element 252 is a seal having a plurality of openings 253 to allow fluid communication between the channels 266 of the barrier unit 260 and the corresponding compartments 284 of the electrode unit 280.

The illustrated vessel 210 further includes a first attachment assembly 254*a* for attaching the barrier unit 260 to the processing unit 220 and a second attachment assembly 254*b* for attaching the electrode unit 280 to the barrier unit 260. The first and second attachment assemblies 254*a-b* can be quick-release devices to securely hold the corresponding units together. For example, the first and second attachment assemblies 254*a-b* can include clamp rings 255*a-b* and latches 256*a-b* that move the clamp rings 255*a-b* between a first position and a second position. As the latches 256*a-b* move the clamp rings 255*a-b* from the first position to the second position, the diameter of the clamp rings 255*a-b* decreases to clamp the corresponding units together. Optionally, as the first and second attachment assemblies 254*a-b* move from the first position to the second position, the attachment assemblies 254*a-b* drive the corresponding units together to compress the interface elements 250 and 252 and properly position the units relative to each other. Suitable attachment assemblies of this type are disclosed in detail in U.S. Patent Application No. 60/476,881, filed Jun. 6, 2003, which is hereby incorporated by reference in its entirety. In other embodiments, the attachment assemblies 254*a-b* may not be quick-release devices and can include a plurality of clamp rings, a plurality of latches, a plurality of bolts, or other types of fasteners.

One advantage of the vessel 210 illustrated in FIGS. 4 and 5 is that worn components in the barrier unit 260 and/or the electrode unit 280 can be replaced without shutting down the processing unit 220 for a significant period of time. The barrier unit 260 and/or the electrode unit 280 can be quickly removed from the processing unit 220 and then a replacement barrier and/or electrode unit can be attached in only a matter of minutes. This significantly reduces the downtime for repairing electrodes or other processing components compared to conventional systems that require the components to be repaired in situ on the vessel or require the entire chamber to be removed from the vessel.

An alternate embodiment of the barrier unit 260 can include a porous barrier instead of the nonporous barrier 270 shown and described above with reference to FIGS. 4 and 5. Such a porous barrier can generally separate the first and second flow systems, but the porous barrier generally allows some fluid to flow between the first and second flow systems.

D. Additional Embodiments of Electrochemical Deposition Vessels

Figure 6:
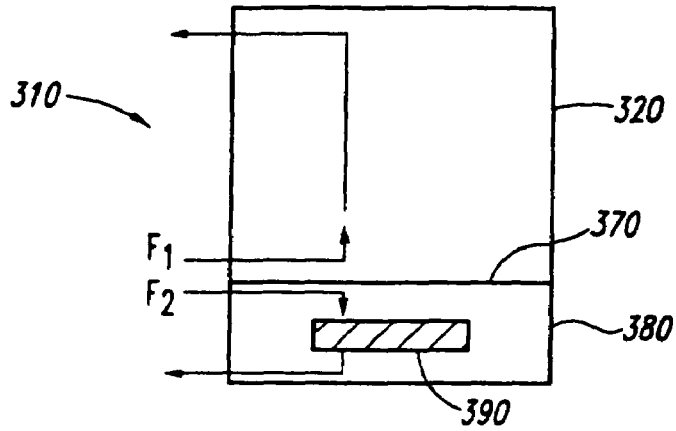
FIG. 6 is a schematic view of a wet chemical vessel in accordance with another embodiment of the invention.

FIG. 6 is a schematic view of a wet chemical vessel 310 in accordance with another embodiment of the invention. The vessel 310 includes a processing unit 320 (shown schematically), an electrode unit 380 (shown schematically), and a barrier 370 (shown schematically) separating the processing and electrode units 320 and 380. The processing unit 320 and the electrode unit 380 can be generally similar to the processing and electrode units 220 and 280 described above with reference to FIGS. 4 and 5. For example, the processing unit 320 can include a portion of a first flow system to convey a flow of a first processing fluid toward the workpiece at a processing site, and the electrode unit 380 can include at least one electrode 390 and a portion of a second flow system to convey a flow of a second processing fluid at least proximate to the electrode 390. The barrier 370 can be a nonporous barrier or a porous barrier.

Unlike the vessel 210, the vessel 310 does not include a separate barrier unit but rather the barrier 370 is attached directly between the processing unit 320 and the electrode unit 380. The barrier 370 otherwise separates the first processing fluid in the processing unit 320 and the second processing fluid in the electrode unit 380 in much the same manner as the nonporous barrier 270. Another difference with the vessel 210 is that the barrier 370 and the electrode unit 380 are not canted relative to the processing unit 320.

The first and second processing fluids can flow in the vessel 310 in a direction that is opposite to the flow direction described above with reference to the vessel 210 of FIGS. 4 and 5. More specifically, the first processing fluid can flow along a path $F_1$ from the barrier 370 toward the workpiece and exit the vessel 310 proximate to the processing site. The second processing fluid can flow along a path $F_2$ from the barrier 370 toward the electrode 390 and then exit the vessel 310. In other embodiments, the vessel 310 can include a device to degas the first and/or second processing fluids.

Figure 7:
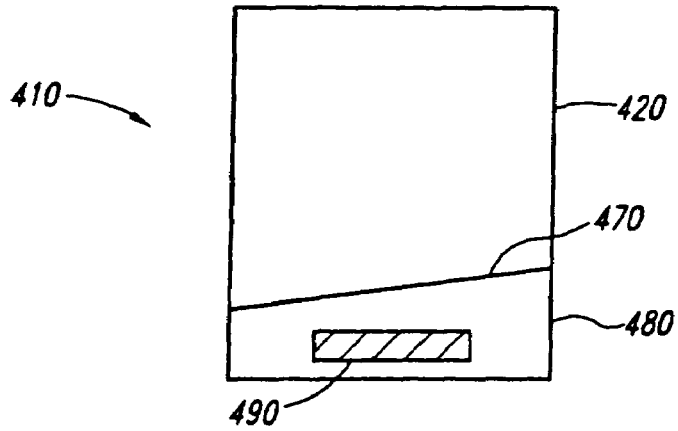
FIG. 7 is a schematic view of a wet chemical vessel in accordance with another embodiment of the invention.
Figure 8:
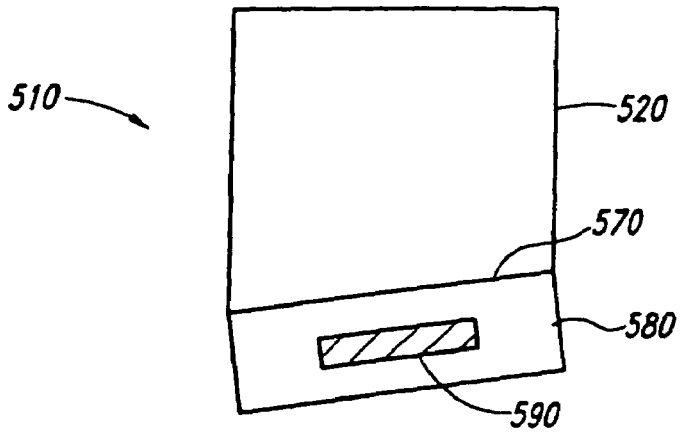
FIG. 8 is a schematic view of a wet chemical vessel in accordance with another embodiment of the invention.

FIG. 7 schematically illustrates a vessel 410 having a processing unit 420, an electrode unit 480, and a barrier 470 canted relative to the processing and electrode units 420 and 480. This embodiment is similar to the vessel 310 in that it does not have a separate barrier unit and the barrier 470 can be nonporous or porous, but the vessel 410 differs from the vessel 310 in that the barrier 470 is canted at an angle. Alternatively, FIG. 8 schematically illustrates a vessel 510 including a processing unit 520, an electrode unit 580, and a barrier 570 between the processing and electrode units 520 and 580. The vessel 510 is similar to the vessel 410, but the barrier 570 and the electrode unit 580 are both canted relative to the processing unit 520 in the vessel 510.

E. Embodiments of Integrated Tools with Mounting Modules

Figure 9:
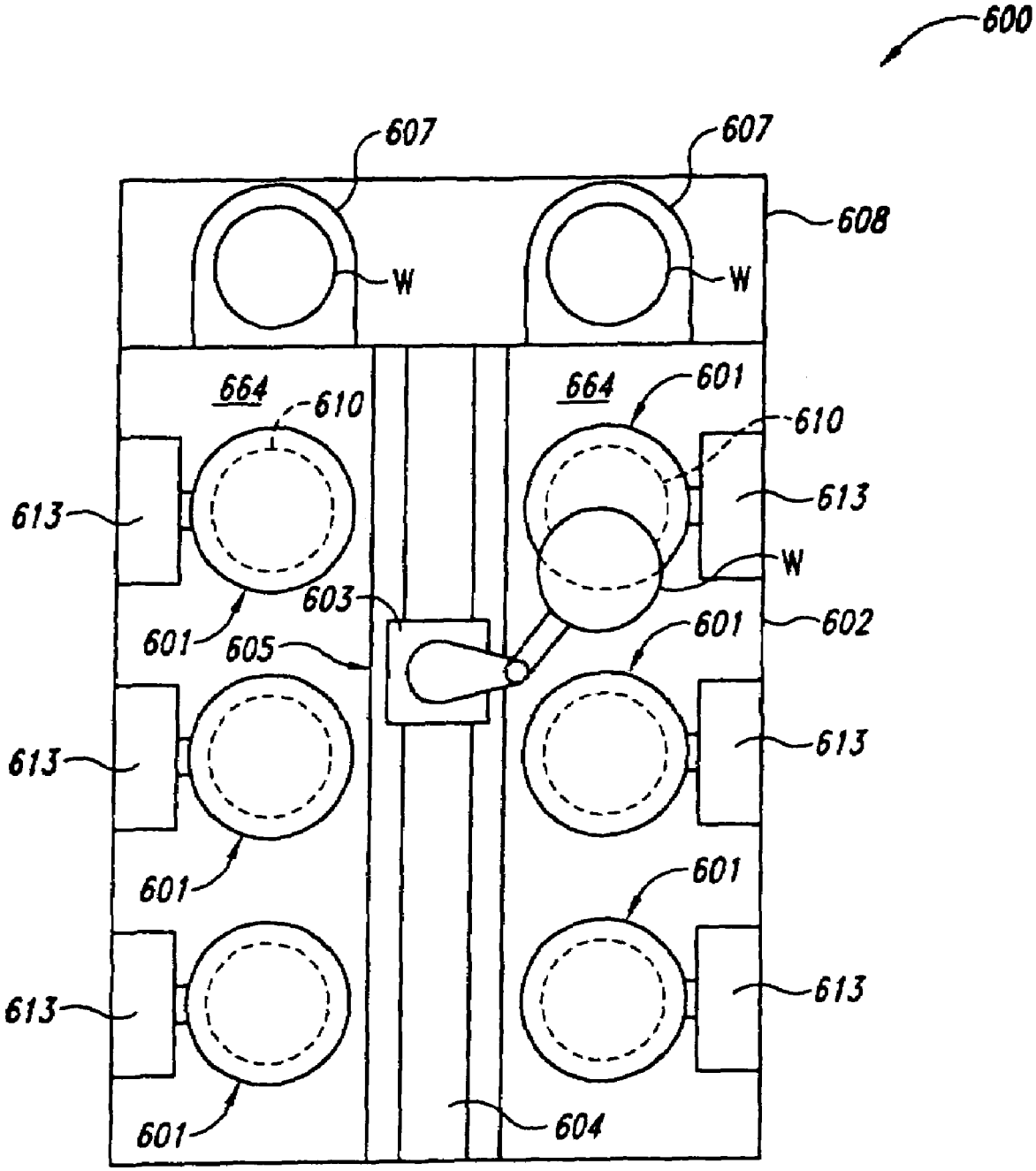
FIG. 9 is a schematic top plan view of a wet chemical processing tool in accordance with another embodiment of the invention.

FIG. 9 schematically illustrates an integrated tool 600 that can perform one or more wet chemical processes. The tool 600 includes a housing or cabinet 602 that encloses a deck 664, a plurality of wet chemical processing stations 601, and a transport system 605. Each processing station 601 includes a vessel, chamber, or reactor 610 and a workpiece support (for example, a lift-rotate unit) 613 for transferring microfeature workpieces W into and out of the reactor 610. The vessel, chamber, or reactor 610 can be generally similar to any one of the vessels described above with reference to FIGS. 2A-8. The stations 601 can include spin-rinse-dry chambers, seed layer repair chambers, cleaning capsules, etching capsules, electrochemical deposition chambers, and/or other types of wet chemical processing vessels. The transport system 605 includes a linear track 604 and a robot 603 that moves along the track 604 to transport individual workpieces W within the tool 600. The integrated tool 600 further includes a workpiece load/unload unit 608 having a plurality of containers 607 for holding the workpieces W. In operation, the robot 603 transports workpieces W to/from the containers 607 and the processing stations 601 according to a predetermined workflow schedule within the tool 600. For example, individual workpieces W can pass through a seed layer repair process, a plating process, a spin-rinse-dry process, and an annealing process. Alternatively, individual workpieces W may not pass through a seed layer repair process or may otherwise be processed differently.

Figure 10A:
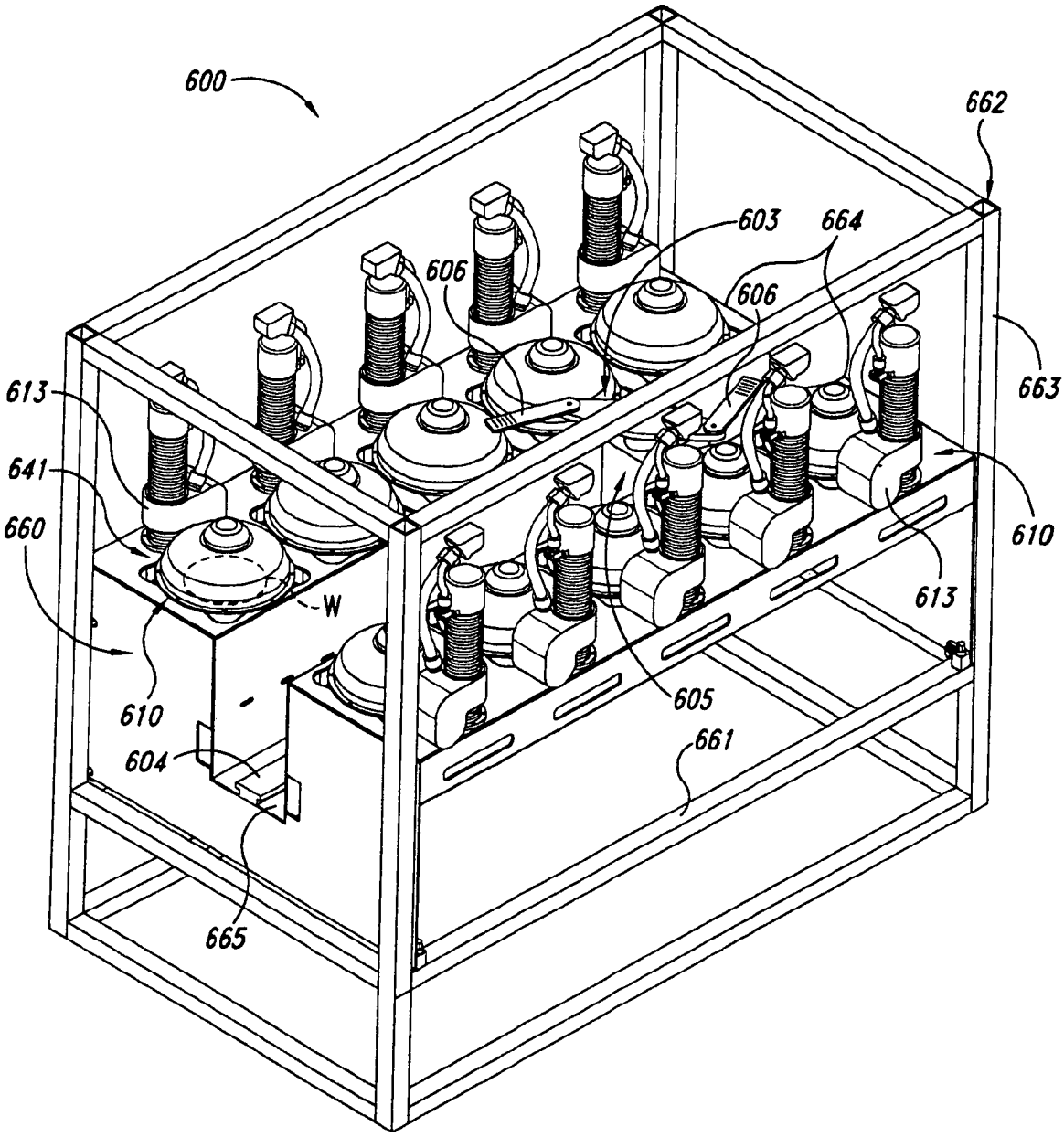
FIG. 10A is an isometric view illustrating a portion of a wet chemical processing tool in accordance with another embodiment of the invention.

FIG. 10A is an isometric view showing a portion of an integrated tool 600 in accordance with an embodiment, of the invention. The integrated tool 600 includes a frame 662, a dimensionally stable mounting module 660 mounted to the frame 662, a plurality of wet chemical processing chambers 610, and a plurality of workpiece supports 613. The tool 600 can also include a transport system 605. The mounting module 660 carries the processing chambers 610, the workpiece supports 613, and the transport system 605.

The frame 662 has a plurality of posts 663 and cross-bars 661 that are welded together in a manner known in the art. A plurality of outer panels and doors (not shown in FIG. 10A) are generally attached to the frame 662 to form an enclosed cabinet 602 (FIG. 9). The mounting module 660 is at least partially housed within the frame 662. In one embodiment, the mounting module 660 is carried by the cross-bars 661 of the frame 662, but the mounting module 660 can alternatively stand directly on the floor of the facility or other structures.

The mounting module 660 is a rigid, stable structure that maintains the relative positions between the wet chemical processing chambers 610, the workpiece supports 613, and the transport system 605. One aspect of the mounting module 660 is that it is much more rigid and has a significantly greater structural integrity compared to the frame 662 so that the relative positions between the wet chemical processing chambers 610, the workpiece supports 613, and the transport system 605 do not change over time. Another aspect of the mounting module 660 is that it includes a dimensionally stable deck 664 with positioning elements at precise locations for positioning the processing chambers 610 and the workpiece supports 613 at known locations on the deck 664. In one embodiment (not shown), the transport system 605 is mounted directly to the deck 664. In an arrangement shown in FIG. 10A, the mounting module 660 also has a dimensionally stable platform 665 and the transport system 605 is mounted to the platform 665. The deck 664 and the platform 665 are fixedly positioned relative to each other so that positioning elements on the deck 664 and positioning elements on the platform 665 do not move relative to each other. The mounting module 660 accordingly provides a system in which wet chemical processing chambers 610 and workpiece supports 613 can be removed and replaced with interchangeable components in a manner that accurately positions the replacement components at precise locations on the deck 664.

The tool 600 is particularly suitable for applications that have demanding specifications which require frequent maintenance of the wet chemical processing chambers 610, the workpiece support 613, or the transport system 605. A wet chemical processing chamber 610 can be repaired or maintained by simply detaching the chamber from the processing deck 664 and replacing the chamber 610 with an interchangeable chamber having mounting hardware configured to interface with the positioning elements on the deck 664. Because the mounting module 660 is dimensionally stable and the mounting hardware of the replacement processing chamber 610 interfaces with the deck 664, the chambers 610 can be interchanged on the deck 664 without having to recalibrate the transport system 605. This is expected to significantly reduce the downtime associated with repairing or maintaining the processing chambers 610 so that the tool 600 can maintain a high throughput in applications that have stringent performance specifications.

Figure 10B:
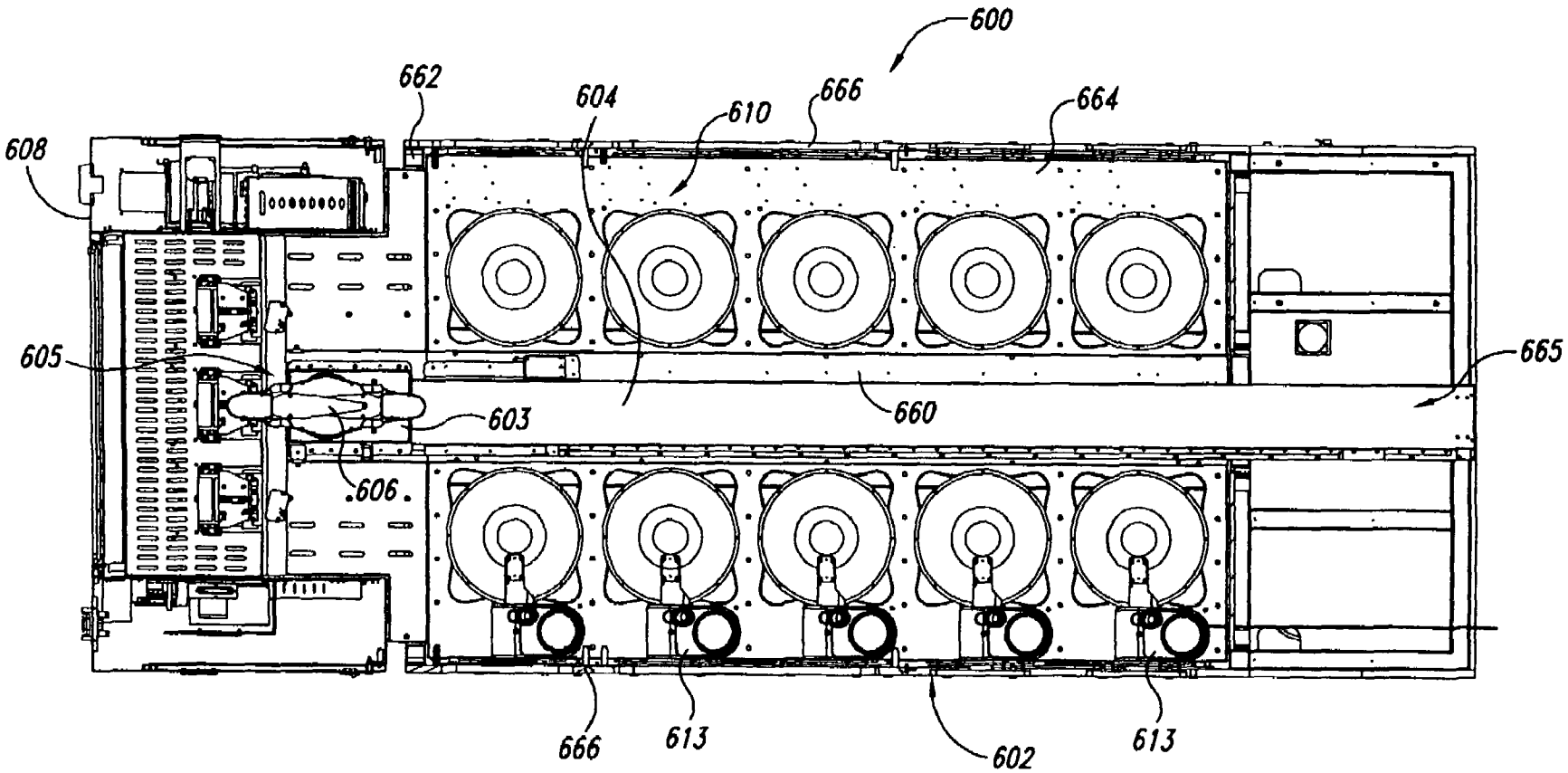
FIG. 10B is a top plan view of a wet chemical processing tool arranged in accordance with another embodiment of the invention.

FIG. 10B is a top plan view of the tool 600 illustrating the transport system 605 and the load/unload unit 608 attached to the mounting module 660. Referring to FIGS. 10A and 10B together, the track 604 is mounted to the platform 665 and in particular, interfaces with positioning elements on the platform 665 so that it is accurately positioned relative to the chambers 610 and the workpiece supports 613 attached to the deck 664. The robot 603 (which includes end-effectors 606 for grasping the workpiece W) can accordingly move the workpiece W in a fixed, dimensionally stable reference frame established by the mounting module 660. Referring to FIG. 10B, the tool 600 can further include a plurality of panels 666 attached to the frame 662 to enclose the mounting module 660, the wet chemical processing chambers 610, the workpiece supports 613, and the transport system 605 in the cabinet 602. Alternatively, the panels 666 on one or both sides of the tool 600 can be removed in the region above the processing deck 664 to provide an open tool.

F. Embodiments of Dimensionally Stable Mounting Modules

Figure 11:
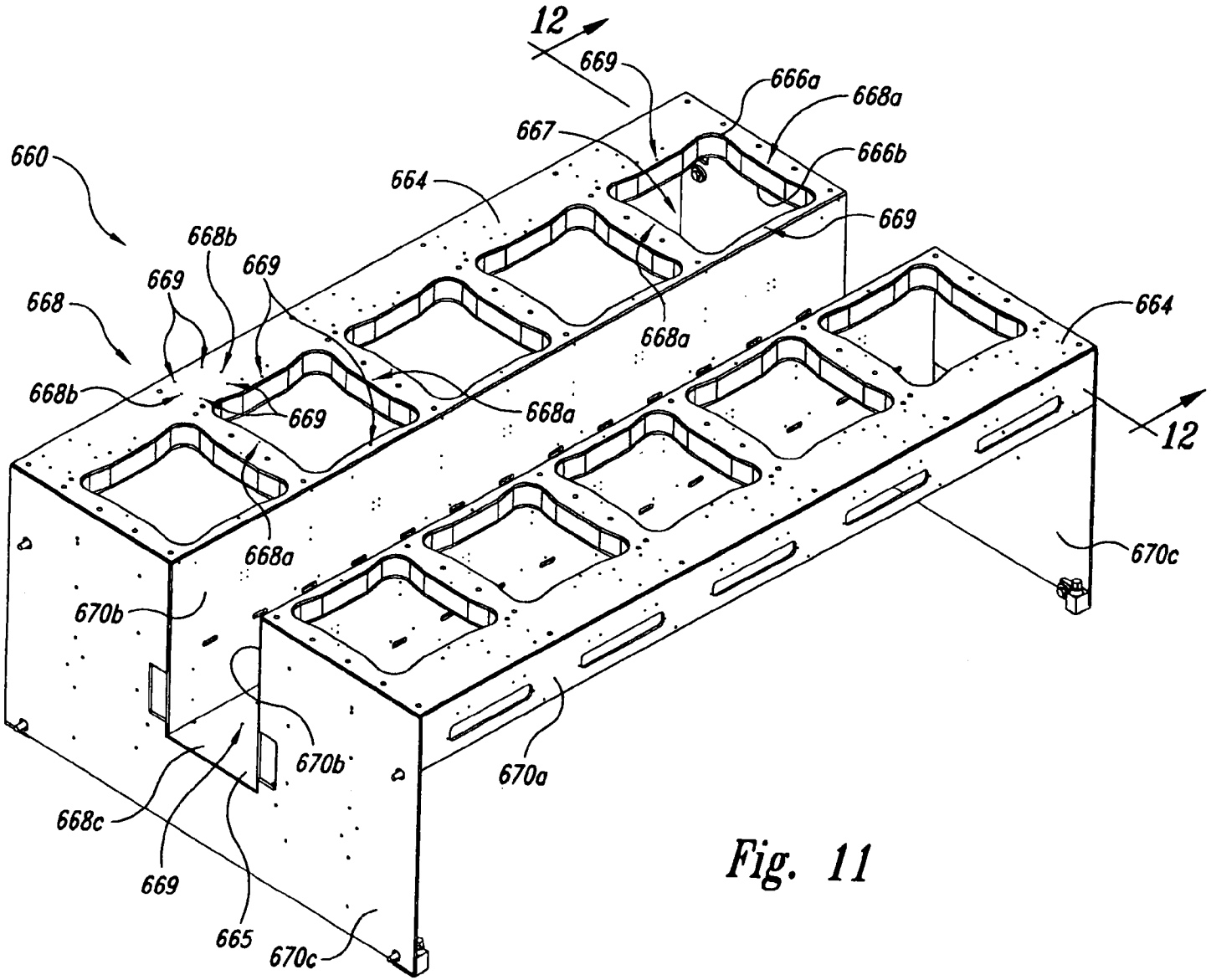
FIG. 11 is an isometric view of a mounting module for use in a wet chemical processing tool in accordance with another embodiment of the invention.

FIG. 11 is an isometric view of a mounting module 660 configured in accordance with an embodiment of the invention for use in the tool 600 (FIGS. 9-10B). The deck 664 includes a rigid first panel 666*a* and a rigid second panel 666*b* superimposed underneath the first panel 666*a*. The first panel 666*a* is an outer member and the second panel 666*b* is an interior member juxtaposed to the outer member. Alternatively, the first and second panels 666*a* and 666*b* can have different configurations than the one shown in FIG. 11. A plurality of chamber receptacles 667 are disposed in the first and second panels 666*a* and 666*b* to receive the wet chemical processing chambers 610 (FIG. 10A).

The deck 664 further includes a plurality of positioning elements 668 and attachment elements 669 arranged in a precise pattern across the first panel 666*a*. The positioning elements 668 include holes machined in the first panel 666*a* at precise locations, and/or dowels or pins received in the holes. The dowels are also configured to interface with the wet chemical processing chambers 610 (FIG. 10A). For example, the dowels can be received in corresponding holes or other interface members of the processing chambers 610. In other embodiments, the positioning elements 668 include pins, such as cylindrical pins or conical pins, that project upwardly from the first panel 666*a* without being positioned in holes in the first panel 666*a*. The deck 664 has a set of first chamber positioning elements 668*a* located at each chamber receptacle 667 to accurately position the individual wet chemical processing chambers at precise locations on the mounting module 660. The deck 664 can also include a set of first support positioning elements 668*b* near each receptacle 667 to accurately position individual workpiece supports 613 (FIG. 10A) at precise locations on the mounting module 660. The first support positioning elements 668*b* are positioned and configured to mate with corresponding positioning elements of the workpiece supports 613. The attachment elements 669 can be threaded holes in the first panel 666*a* that receive bolts to secure the chambers 610 and the workpiece supports 613 to the deck 664.

The mounting module 660 also includes exterior side plates 670*a* along longitudinal outer edges of the deck 664, interior side plates 670*b* along longitudinal inner edges of the deck 664, and endplates 670*c* attached to the ends of the deck 664. The transport platform 665 is attached to the interior side plates 670*b* and the end plates 670*c*. The transport platform 665 includes track positioning elements 668*c* for accurately positioning the track 604 (FIGS. 10A and 10B) of the transport system 605 (FIGS. 10A and 10B) on the mounting module 660. For example, the track positioning elements 668*c* can include pins or holes that mate with corresponding holes, pins or other interface members of the track 604. The transport platform 665 can further include attachment elements 669, such as tapped holes, that receive bolts to secure the track 604 to the platform 665.

Figure 12:
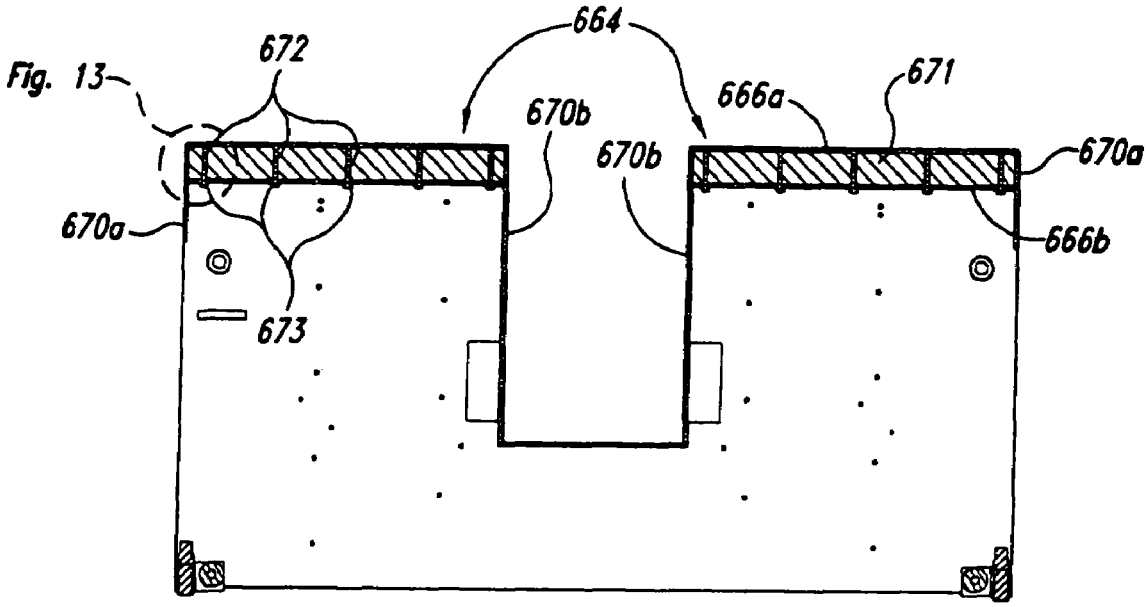
FIG. 12 is cross-sectional view along line 12-12 of FIG. 11 of a mounting module for use in a wet chemical processing tool in accordance with another embodiment of the invention.
Figure 13:
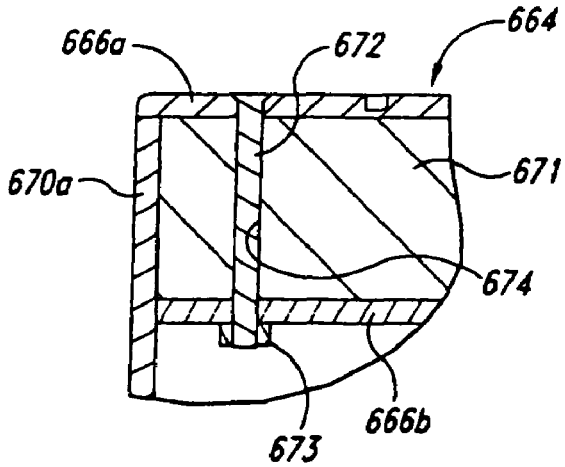
FIG. 13 is a cross-sectional view showing a portion of a deck of a mounting module in greater detail.

FIG. 12 is a cross-sectional view illustrating one suitable embodiment of the internal structure of the deck 664, and FIG. 13 is a detailed view of a portion of the deck 664 shown in FIG. 12. The deck 664 includes bracing 671, such as joists, extending laterally between the exterior side plates 670*a* and the interior side plates 670*b*. The first panel 666*a* is attached to the upper side of the bracing 671, and the second panel 666*b* is attached to the lower side of the bracing 671. The deck 664 can further include a plurality of throughbolts 672 and nuts 673 that secure the first and second panels 666*a* and 666*b* to the bracing 671. As best shown in FIG. 13, the bracing 671 has a plurality of holes 674 through which the throughbolts 672 extend. The nuts 673 can be welded to the bolts 672 to enhance the connection between these components.

The panels and bracing of the deck 664 can be made from stainless steel, other metal alloys, solid cast materials, or fiber-reinforced composites. For example, the panels and plates can be made from Nitronic 50 stainless steel, Hastelloy 625 steel alloys, or a solid cast epoxy filled with mica. The fiber-reinforced composites can include a carbon-fiber or Kevlar® mesh in a hardened resin. The material for the panels 666*a* and 666*b* should be highly rigid and compatible with the chemicals used in the wet chemical processes. Stainless steel is well-suited for many applications because it is strong but not affected by many of the electrolytic solutions or cleaning solutions used in wet chemical processes. In one embodiment, the panels and plates 666*a-b* and 670*a-c* are 0.125 to 0.375 inch thick stainless-steel, and more specifically they can be 0.250 inch thick stainless steel. The panels and plates, however, can have different thicknesses in other embodiments.

The bracing 671 can also be stainless steel, fiber-reinforced composite materials, other metal alloys, and/or solid cast materials. In one embodiment, the bracing can be 0.5 to 2.0 inch wide stainless steel joists, and more specifically 1.0 inch wide by 2.0 inches tall stainless steel joists. In other embodiments the bracing 671 can be a honey-comb core or other structures made from metal (e.g., stainless steel, aluminum, titanium, etc.), polymers, fiber glass or other materials.

The mounting module 660 is constructed by assembling the sections of the deck 664, and then welding or otherwise adhering the end plates 670*c* to the sections of the deck 664. The components of the deck 664 are generally secured together by the throughbolts 672 without welds. The outer side plates 670*a* and the interior side plates 670*b* are attached to the deck 664 and the end plates 670*c* using welds and/or fasteners. The platform 665 is then securely attached to the end plates 670*c*, and the interior side plates 670*b*. The order in which the mounting module 660 is assembled can be varied and is not limited to the procedure explained above.

The mounting module 660 provides a heavy-duty, dimensionally stable structure that maintains the relative positions between the positioning elements 668*a-b* on the deck 664 and the positioning elements 668*c* on the platform 665 within a range that does not require the transport system 605 to be recalibrated each time a replacement processing chamber 610 or workpiece support 613 is mounted to the deck 664. The mounting module 660 is generally a rigid structure that is sufficiently strong to maintain the relative positions between the positioning elements 668*a-b* and 668*c* when the wet chemical processing chambers 610, the workpiece supports 613, and the transport system 605 are mounted to the mounting module 660. In several embodiments, the mounting module 660 is configured to maintain the relative positions between the positioning elements 668*a-b* and 668*c* to within 0.025 inch. In other embodiments, the mounting module is configured to maintain the relative positions between the positioning elements 668*a-b* and 668*c* to within approximately 0.005 to 0.015 inch. As such, the deck 664 often maintains a uniformly flat surface to within approximately 0.025 inch, and in more specific embodiments to approximately 0.005-0.015 inch.

From the foregoing, it will be appreciated that specific embodiments of the invention have been described herein for purposes of illustration, but that various modifications may be made without deviating from the spirit and scope of the invention. For example, various aspects of any of the foregoing embodiments can be combined in different combinations, or features such as the sizes, material types, and/or fluid flows can be different. Accordingly, the invention is not limited except as by the appended claims.

We claim:

1. An electrochemical deposition chamber for depositing material onto microfeature workpieces, the chamber comprising:

a processing unit including a first flow system configured to convey a flow of a first processing fluid to a microfeature workpiece at a processing site;

an electrode unit including first and second electrode compartments and a second flow system separate from the first flow system, the second flow system being configured to convey a flow of a second processing fluid through the electrode compartment;

a barrier between the processing unit and the electrode unit that prevents nonionic species from passing between the first and second flow systems;

a first electrode in the first electrode compartment and a second electrode in the second electrode compartment and arranged concentrically with the first electrode, with the first and second electrodes substantially equally spaced apart from the barrier; and the processing unit further comprising a field shaping module, the field shaping module of a dielectric material and having a first opening facing a first section of the processing site through which ions influenced by the first electrode can pass and a second opening facing a second section of the processing site through which ions influenced by the second electrode can pass.

2. The chamber of claim 1 wherein the barrier is canted relative to the processing unit to vent gas from the second processing fluid.

3. The chamber of claim 1, further comprising a barrier unit coupled tote processing and electrode units, the barrier unit including the barrier.

4. An electrochemical processor comprising:

a processing unit;

a field shaping module in the processing unit having a first partition and a second partition around the first partition, and a first opening within the first partition and a second opening between the first and second partitions;

an electrode unit attached to the processing unit;

first and second electrode compartments in the electrode unit;

a first electrode in the first electrode compartment and a second electrode in the second electrode compartment, with the second electrode concentric and substantially vertically aligned with the first electrode;

first and second channels extending from the first and second electrode compartments to the first and second openings, respectively; and a flat nonporous barrier in the first and second channels, between the processing unit and the electrode unit.

5. The processor of claim 4 with the first and second electrodes each having a generally rectangular cross section including a top surface and a bottom surface, and with the top surface of the first electrode at substantially the seine vertical position as the top surface of the second electrode.

6. The processor of claim 5 with the bottom surface of the first and second electrodes positioned at a bottom end of the first and second electrode compartments, respectively.

7. The processor of claim 4 with the second electrode substantially entirely circumferentially surrounding the first electrode.

8. The processor of claim 4 with the nonporous barrier comprising a single membrane.

9. The processor of claim 4 with the nonporous barrier comprising a membrane oriented in a near horizontal plane.

* * * * *